US007367127B2

(12) United States Patent
Nakakura et al.

(10) Patent No.: US 7,367,127 B2
(45) Date of Patent: May 6, 2008

(54) HAIR TRIMMER WITH RATTLE DAMPENING STRUCTURE

(75) Inventors: Makoto Nakakura, Osaka (JP); Hitoshi Ogawa, Osaka (JP); Seiko Yabuuchi, Osaka (JP)

(73) Assignee: Matsushita Electric Works, Ltd., Osaka (JP)

( * ) Notice: Subject to any disclaimer, the term of this patent is extended or adjusted under 35 U.S.C. 154(b) by 296 days.

(21) Appl. No.: 10/926,140

(22) Filed: Aug. 26, 2004

(65) Prior Publication Data

US 2005/0044719 A1 Mar. 3, 2005

(30) Foreign Application Priority Data

Aug. 29, 2003 (JP) ..... 2003-307759

(51) Int. Cl.
*B26B 19/20* (2006.01)
*B26B 19/02* (2006.01)

(52) U.S. Cl. ..... 30/233.5; 30/43.92; 30/201

(58) Field of Classification Search ..... 30/34.1, 30/43.92, 200, 201, 208, 210, 216, 233, 233.5; D28/53

See application file for complete search history.

(56) References Cited

U.S. PATENT DOCUMENTS 4,614,036 A * 9/1986 Haraguchi ..... 30/200
4,669,189 A * 6/1987 Ullmann ..... 30/201
5,050,305 A * 9/1991 Baker et al. ..... 30/201
5,054,199 A * 10/1991 Ogawa et al. ..... 30/34.1
5,105,541 A * 4/1992 Messinger et al. ..... 30/34.1
5,604,985 A * 2/1997 Andis et al. ..... 30/132
5,898,999 A * 5/1999 Chaouachi et al. ..... 30/201
6,243,955 B1 * 6/2001 Forbers et al. ..... 30/233.5
6,578,269 B2 * 6/2003 Wilcox et al. ..... 30/201
6,742,262 B2 * 6/2004 Rizzuto et al. ..... 30/201
6,968,623 B2 * 11/2005 Braun et al. ..... 30/201

FOREIGN PATENT DOCUMENTS

DE 3529516 A1 2/1987
JP 53042969 4/1978
JP 01-214388 8/1989

* cited by examiner

*Primary Examiner*—Boyer D. Ashley
*Assistant Examiner*—Edward Landrum
(74) *Attorney, Agent, or Firm*—Bacon & Thomas, PLLC

(57) ABSTRACT

A hair trimmer with a rattle dampening structure, includes an elongated main body; a cutter block having a stationary blade and a movable blade, both of which are comb-shaped and are slidably in contact with each other, the cutter block being protrudingly installed at one end of the main body; a comb-shaped cylindrical comb attachment covering the cutter block such that it is movable in a projected direction of the cutter block; and an elastic member for elastically pressing the comb attachment for trim length adjustment, in a direction approximately perpendicular to a moving direction of the comb attachment.

7 Claims, 23 Drawing Sheets

HAIR TRIMMER WITH RATTLE DAMPENING STRUCTURE

FIELD OF THE INVENTION

The present invention relates to a rattle dampening structure for a comb attachment of a hair trimmer with a cutter block having comb-shaped reciprocating blades, only one of which is movable. The hair trimmer cuts hair and beard by the operation of the reciprocating blades, over which the comb attachment is placed so that the trim length can be varied.

BACKGROUND OF THE INVENTION

Japanese Patent Laid-open Application No. H1-214388 (hereinafter referred to as "Patent 1") discloses therein a trim length adjusting structure for a conventional hair cutter. In the conventional example described in Patent 1, a cutter block consisting of a stationary and movable blade, both of which are comb-shaped and one of which reciprocates, is protrudingly disposed at one end portion of a main body. A cylindrical comb attachment in a comb shape for trim length adjustment is movably engaged at the portion of the main body where the cutter block is disposed and along the projected direction of the cutter block. An elastic hook provided at the rear portion of the comb attachment is engaged with an annular groove provided at the front end of a cylindrical adjustment element which is rotatably and movably disposed around the main body. A protrusion projecting on the exterior surface of the main body is inserted into a spiral groove formed on the inner circumferential surface of the cylindrical adjustment element. By rotating the cylindrical adjustment element, the adjustment element is moved in the longitudinal direction while it rotates around the main body along the spiral groove. As a result, the comb attachment in a comb shape is movable in the projected direction of the cutter block.

Further, hair or beard brought in from the base portion of the comb attachment comes in contact with the stationary blade in a comb shape and then is cut by the movable blade at a desired cutting length. In this case, the cutting length can be adjusted by rotating the adjustment element.

However, in the conventional example above, since the cylindrical comb attachment is merely movably engaged with the main body, it rattles in an approximately perpendicular direction to its movable direction, thereby making a rattling noise while interfering the trimmer's handling quality. Further, also in the area where the protrusion on the main body's exterior surface is inserted in the spiral groove, the cylindrical adjustment element rattles and makes a similar noise. In this case, in order to eliminate such rattling, if the comb attachment and the main body are made to engage tightly, or otherwise, the spiral groove and the protrusion on the main body's exterior surface are tightly fitted, the friction between the parts would increase, so that precise operation of the cutter becomes more difficult. Further, in order to mass produce the cutter with features with such subtle dimensional variations, maintaining the product quality becomes a formidable challenge.

SUMMARY OF THE INVENTION

The present invention has been developed to solve the problems of the conventional cutter discussed above. Accordingly, an object of the present invention is to provide a rattle-dampening structure for a hair trimmer's comb attachment which is for trim length adjustment, wherein the structure has an unsophisticated design which possesses excellent manipulability and allows for an easy guarantee of product quality by eliminating the rattling of the comb attachment.

In accordance with the present invention, there is provided a hair trimmer with a rattle dampening structure, including: an elongated main body; a cutter block having a stationary blade and a movable blade, both of which are comb-shaped and are slidably in contact with each other, the cutter block being protrudingly installed at one end of the main body; a comb-shaped cylindrical comb attachment covering the cutter block such that it is movable in a projected direction of the cutter block; and an elastic member for elastically pressing the comb attachment for trim length adjustment, in a direction approximately perpendicular to a moving direction of the comb attachment.

With such configuration, as for movably (loosely) disposing the cylindrical comb attachment along the reciprocating direction of the cutter block of the main body, even if the comb attachment is slightly loosely sized relative to the main body without requiring exact dimensional precision, the rattling of the comb attachment approximately perpendicular to the trim length adjustment direction can be prevented, thereby eliminating a rattling noise. Further, since the comb attachment can be adjusted smoothly, the manipulability of the trimmer can be enhanced. Still further, as the requirement for dimensional precision becomes less scrupulous, it becomes easier to maintain product quality with an unsophisticated structure.

Further, it is preferable that the elastic member is disposed in the main body.

By providing the elastic member in the main body, the structure of the comb attachment can be made simpler.

Further, it is preferable that the hair trimmer further includes a connecting member, which is moved by a control mechanism, provided in the main body, wherein the connecting member is engaged with the comb attachment at one sidewall of the comb attachment, the elastic member being disposed such that it presses a side of the comb attachment opposing said one sidewall in a direction approximately perpendicular to the moving direction of the comb attachment.

With such configuration, the comb attachment for trim length adjustment can steadily move in a predetermined direction under the guidance of the guiding rail portions to the guided rail portions wherein the guiding allows the comb attachment for trim length adjustment to become movable.

Further, it is preferable that the hair trimmer further includes guided rail portions provided on the comb attachment in parallel with the moving direction of the comb attachment; and guiding rail portions provided on the main body, wherein the guided rail portions are slidably inserted in the guiding rail portions.

With such configuration, the comb attachment for trim length adjustment can steadily move in a predetermined direction under the guidance of the guiding rail portions to the guided rail portions wherein the guiding allows comb attachment for trim length adjustment to become movable.

Further, it is preferable that the hair trimmer further includes a pressure receiving element provided on the comb attachment so that it is in contact with the elastic member; and a receiving groove portion provided in the main body, wherein a part of the pressure receiving element is movably inserted in the receiving groove portion.

With such configuration, since the pressure receiving element does not interfere with a user's grip by touching the holding hand, the trimmer becomes more convenient to use.

BRIEF DESCRIPTION OF THE DRAWINGS

The above and other objects and features of the present invention will become apparent from the following description of preferred embodiments, given in conjunction with the accompanying drawings, in which.

DETAILED DESCRIPTION OF THE PREFERRED EMBODIMENTS

Hereinafter, the present invention will be described in accordance with a preferred embodiment as illustrated in the accompanying drawings.

Figure 1C:
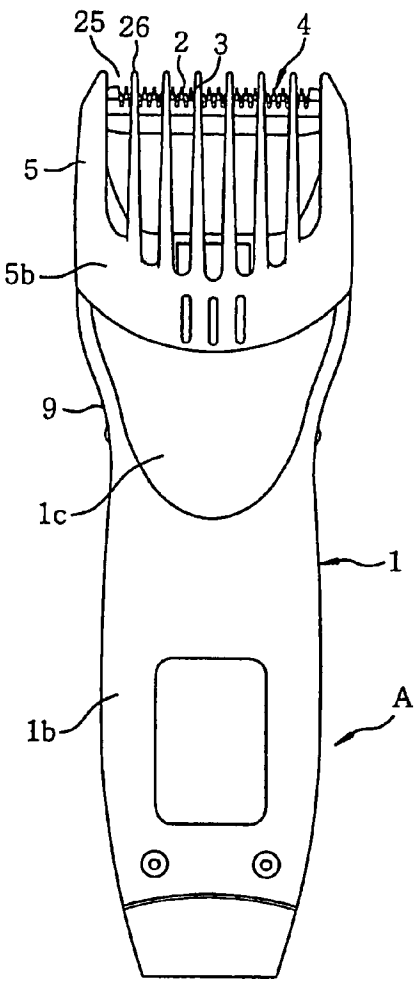
FIGS. 1A to 1C show a front view, a left side view and a rear view of a hair trimmer respectively in accordance with the present invention.
Figure 1B:
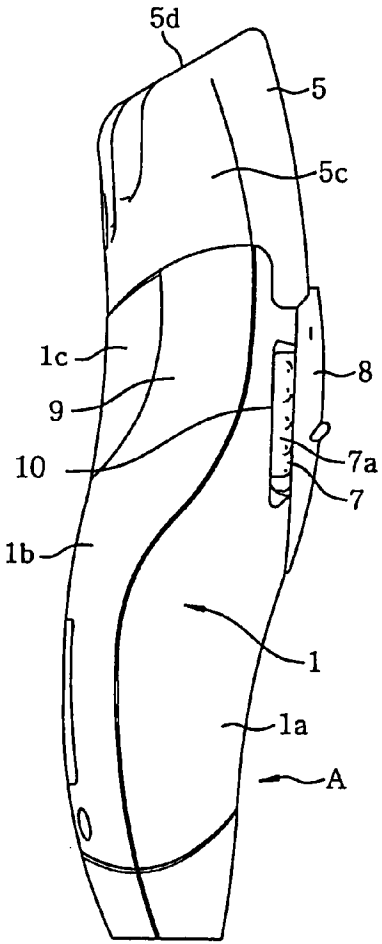
Figure 1A:
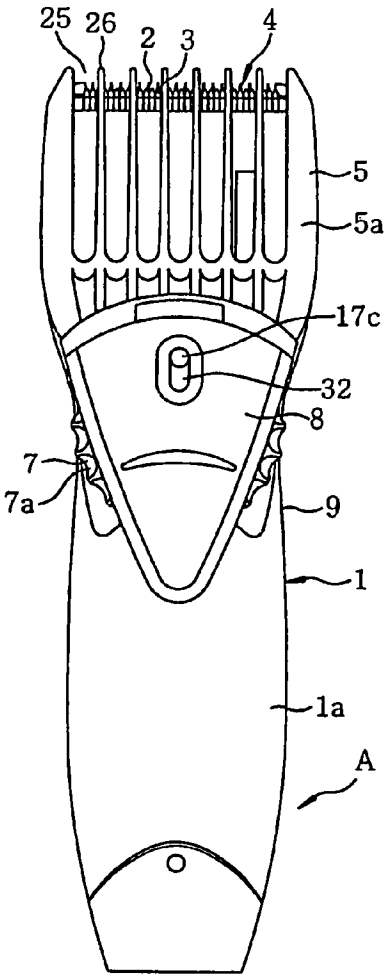
Figure 2A:
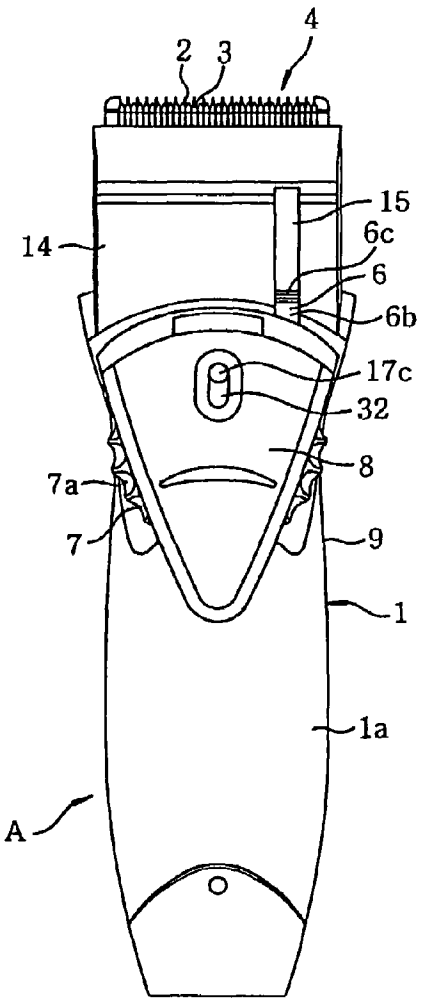
FIGS. 2A to 2C show a front view, a left side view and a rear view of a hair trimmer of the present invention respectively, wherein a comb attachment of the trimmer is detached from the hair trimmer.
Figure 2B:
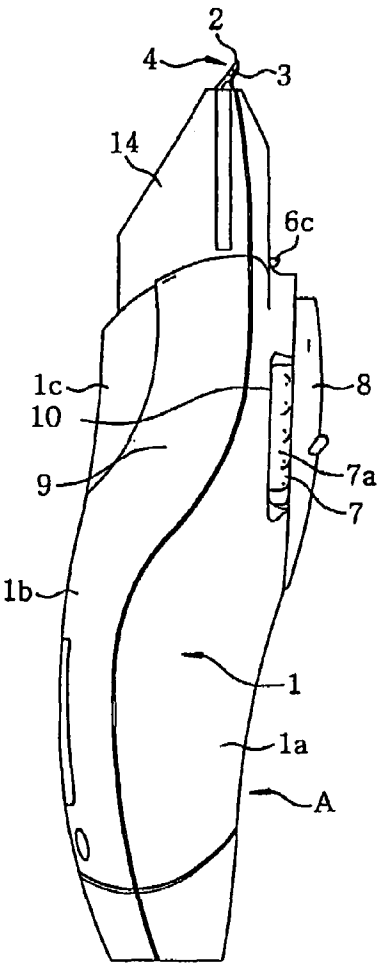
Figure 2C:
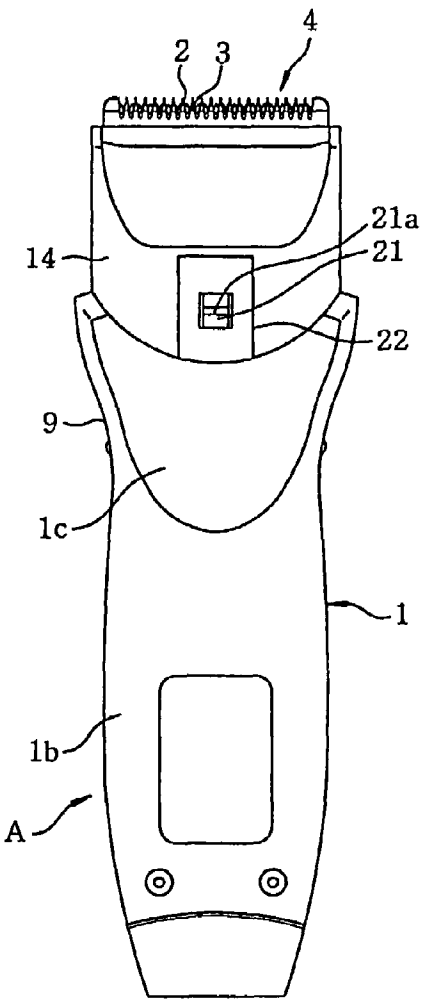

A hair trimmer A is configured such that a cutter block 4 having a stationary blade 2 in combination with a movable blade 3 both of which are comb-shaped and slidably in contact with each other, is protrudingly disposed at one end portion in the lengthwise direction of an approximately cylindrical main body 1 which extends from the one end to the other end portion. The main body 1 is formed as shown in FIGS. 2A to 2C, and among the four side-surfaces established when one end portion where the cutter block 4 is protrudingly disposed is oriented upward so that the opposite end portion points downward, a rotary dial 7 is provided at one of the four side-surfaces in parallel (or approximately parallel) with the corresponding side-surface, and an operation switch 8 for turning on/off an operation of the main body 1 is provided at the exterior of one side-surface of the main body 1 where the rotary dial 7 is provided. Further, a comb attachment placement head 14 movably covered by a comb attachment 5 to be described later is positioned between the main body 1's outermost portion where the cutter block 4 is projected and the portion where the rotary dial 7 and the operation switch 8 are disposed.

In case the one side-surface of the main body 1 where the rotary dial 7 and the operation switch 8 are provided is defined as the front, the comb-shaped movable blade 3 of the cutter block 4 is positioned at the front portion whereas the comb-shaped stationary blade 2 is positioned at the rear portion behind the movable blade 3, as illustrated in FIGS. 2A and 2C. Further, a neck portion 9 having a narrow width between both side faces is positioned slightly off the central portion of the main body toward the cutter block 4, and the rotary dial 7 and the operation switch 8 are provided at the one side-surface (front) perpendicular to both side-surfaces of the neck portion 9 having a narrow width.

Figure 3:
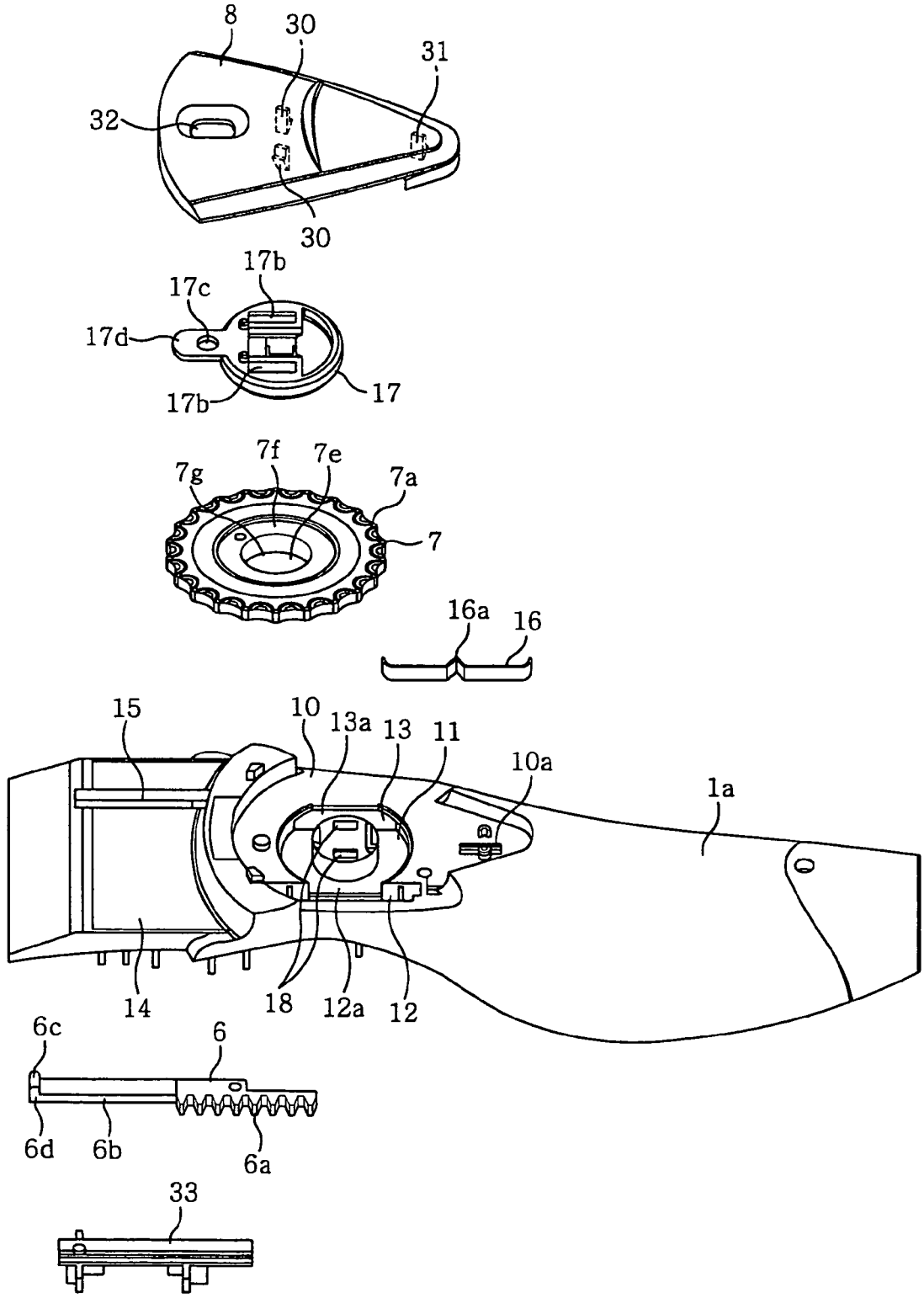
FIG. 3 shows an exploded perspective view of the hair trimmer of the present invention.
Figure 4A:
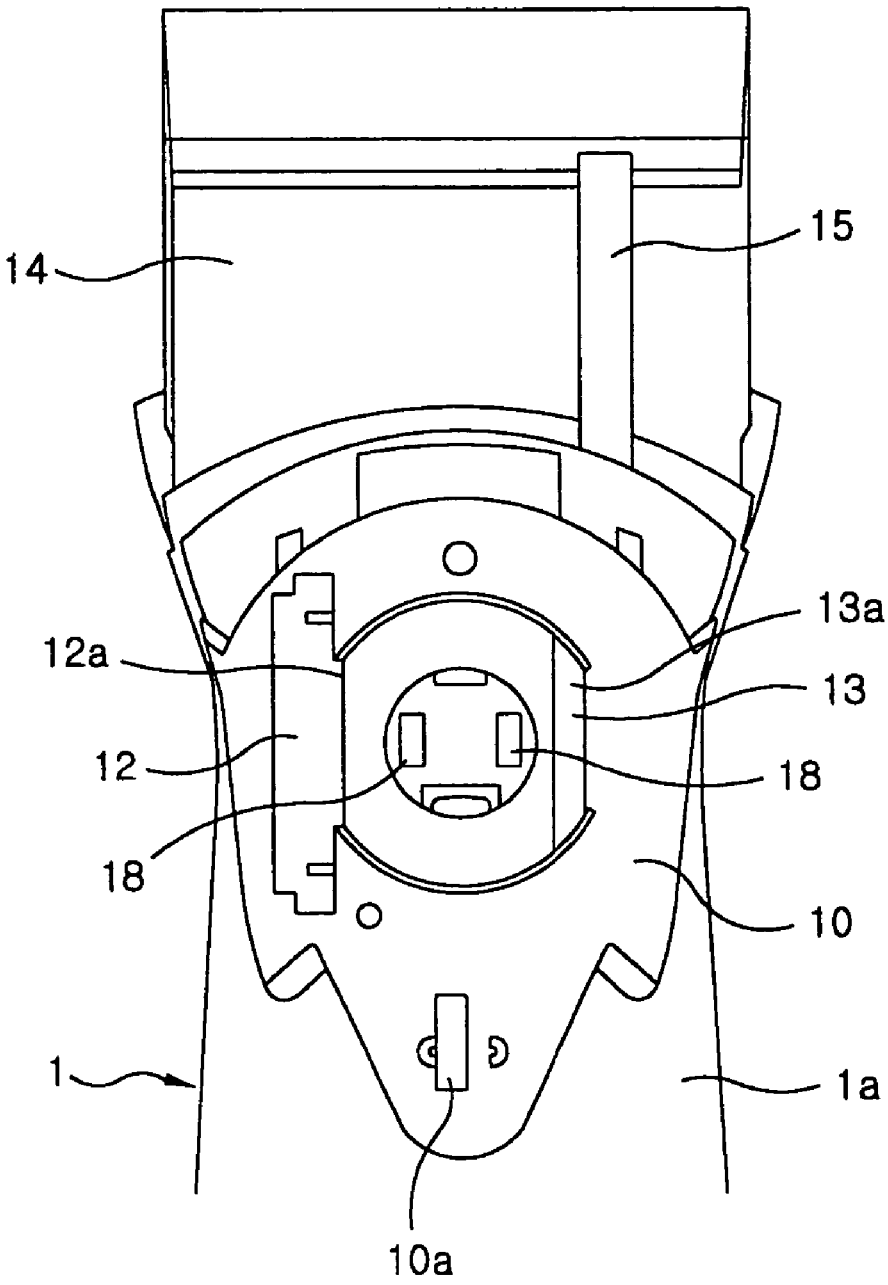
FIGS. 4A to 4E are detailed drawings for illustrative purposes to show the fabrication sequence of the hair trimmer of the present invention.

The main body 1 is provided with housings 1*a*, 1*b* and 1*c*, wherein the housing 1*a* serving as the front portion of the main body 1 is provided with a mortise 10 for disposing the rotary dial 7 and the operation switch 8. An annular recess 11 is additionally formed approximately at the central portion of the mortise 10, and a switching hole 10*a* is provided approximately at the opposite side from the cutter block 4 as the annular recess 11 of the mortise 10 as the point of symmetry. A switch mechanism (not illustrated) is accommodated in the rear portion of the switching hole 10*a* of the housing 1*a*, and an engagement hole (not shown) provided at an operation portion (not shown) for turning on/off the switch mechanism faces the switching hole 10*a*. Engagement holes 18 are provided in the area surrounded by the annular recess 11 of the central portion of the mortise 10, as illustrated in FIG. 3. Further, as shown in FIGS. 3 and 4A, a click spring receiving portion 12 communicates with one of both sides of the annular recess 11, both sides being parallel to the longitudinal direction of the main body 1, via an opening 12*a*, and a connecting member receiving portion 13 communicates with the other side via an opening 13*a*. The connecting member receiving portion 13 communicates with an elongated groove 15 provided at one side of the front portion of the comb attachment placement head 14 wherein the elongated groove 15 is parallel to the longitudinal direction of the main body 1.

Figure 4B:
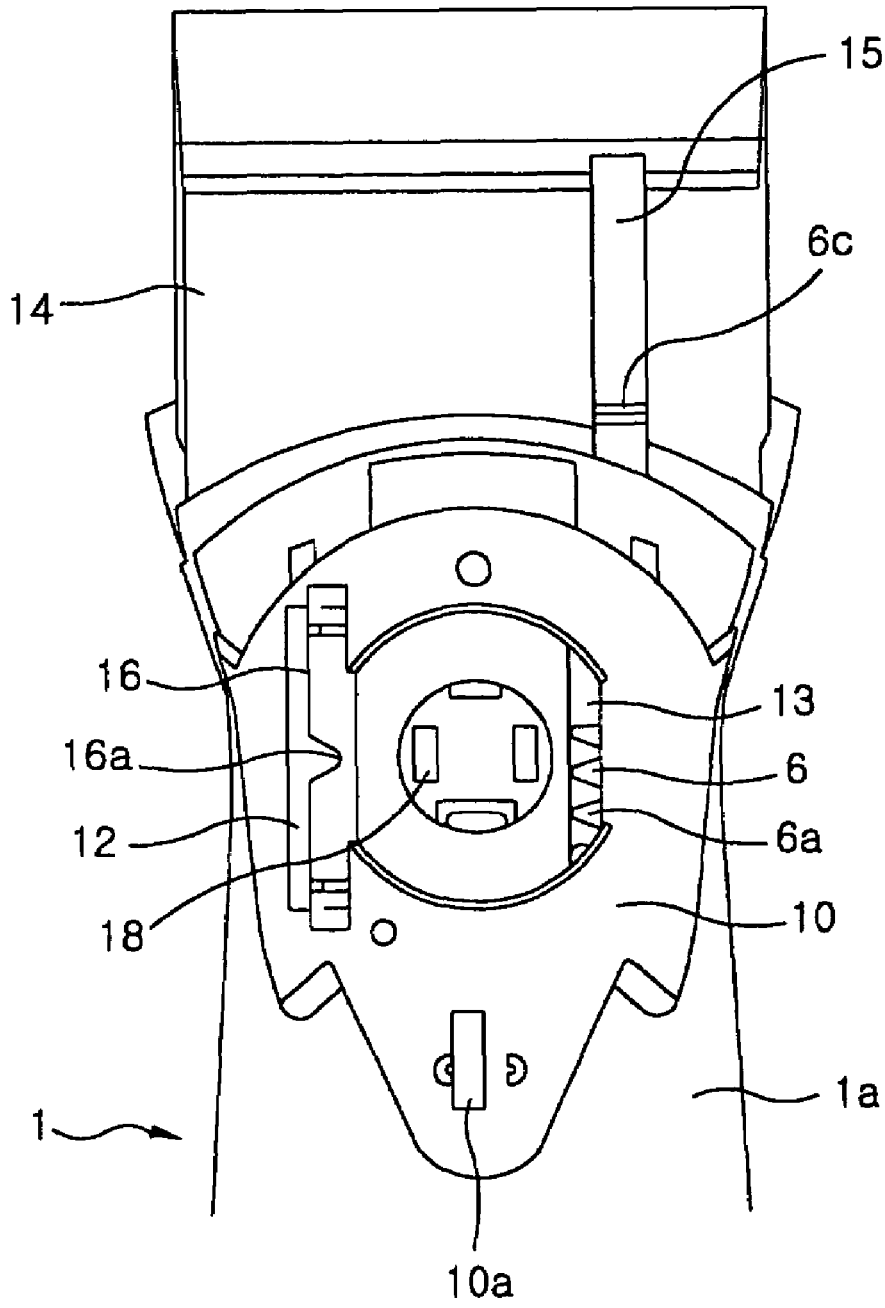

As shown in FIG. 4B, a click spring 16 is accommodated in the click spring receiving portion 12 while a connecting member 6 is slidably accommodated in the connecting member receiving portion 13. In this case, by accommodating the click spring 16 in the click spring receiving portion 12, a push protrusion portion 16*a* of the click spring 16 faces the opening 12*a*. Further, as illustrated in FIG. 3, the connecting member 6 is provided with a rack gear portion 6*a;* a linking arm 6*b* extending from one end portion of the rack gear portion 6*a* in an opposite direction parallel to the rack gear portion 6*a;* and an engaging hook 6*c* projected perpendicular to the linking arm 6*b* from a leading end portion of the linking arm 6*b,* wherein the linking arm 6*b* slides in the elongated groove 15 and the engaging hook 6*c* is outwardly projected from the opening of the elongated groove 15. A rack cover 33 is installed to retain the rack gear portion 6*a* while accommodating the connecting member 6 therein as described above.

Figure 5A:
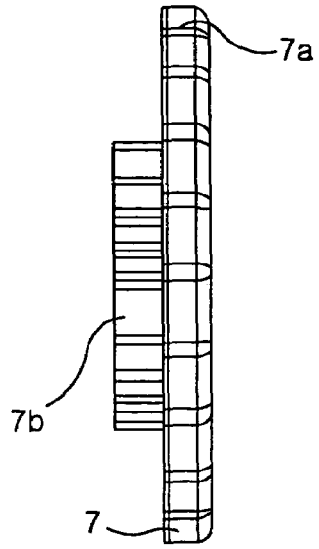
FIGS. 5A and 5B present a front view and a rear view of a rotary dial used in the hair trimmer of the present invention, respectively.
Figure 5B:
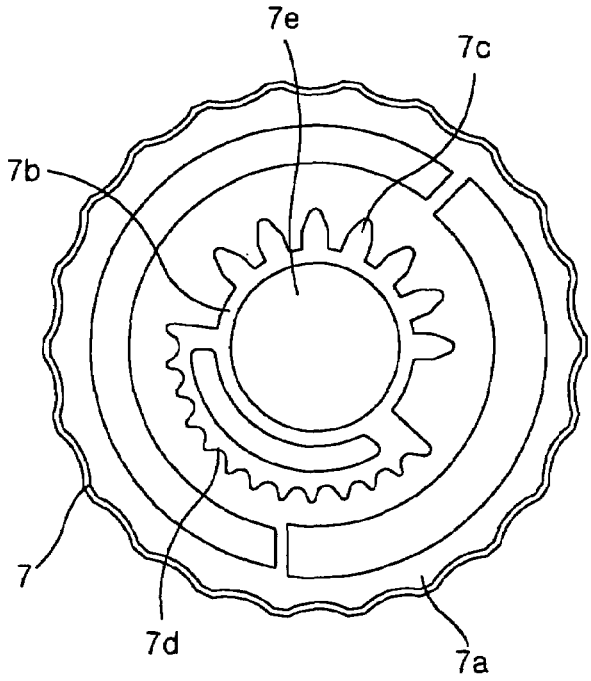
Figure 16:
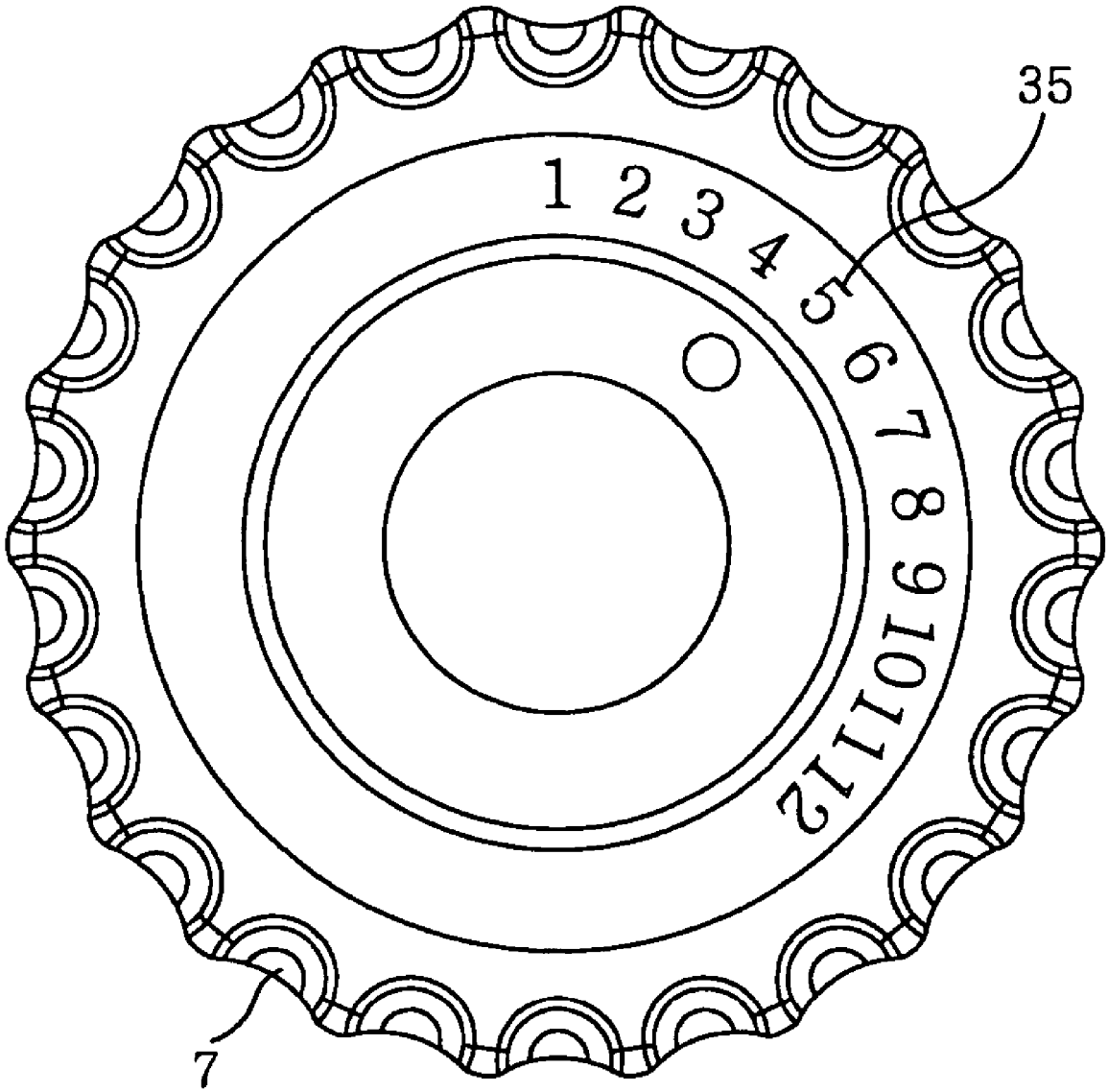
FIG. 16 shows a front view illustrating an example in which control-step marks such as scales, numbers or the like are provided on the rotary dial used in the present invention.

In the rotary dial 7 illustrated in FIGS. 5A and 5B, a rear protrusion portion 7*b* having a smaller diameter than that of a disc-shaped dial unit 7*a* is protrudingly formed on the back side of the dial unit 7*a*. As shown in FIG. 16, the front side of the dial unit 7*a* has alternating protrusions and recesses along its outer circumferential portion to give better finger grip. An interlocking gear wheel 7*c* is provided on a part of the outer circumference of the rear protrusion portion 7*b* and a click gear 7*d* is provided on different part of the outer circumference thereof. Further, the rotary dial 7 is provided with a hole 7*e* which runs from the front surface of the dial through the rear surface of the rear protrusion portion 7*b*. The hole 7*e* has a larger diameter section 7*f* provided at the front side of the rotary dial and a smaller diameter section 7*g* provided at the rear portion of the rotary dial, wherein the smaller diameter section 7*g* has a smaller diameter than that of the larger diameter section 7*f*. Further, as illustrated in FIG. 16, control-step marks 35 displaying such as scales or numbers or the like are provided on the surface of the rotary dial 7 along its circumferential direction.

Figure 4C:
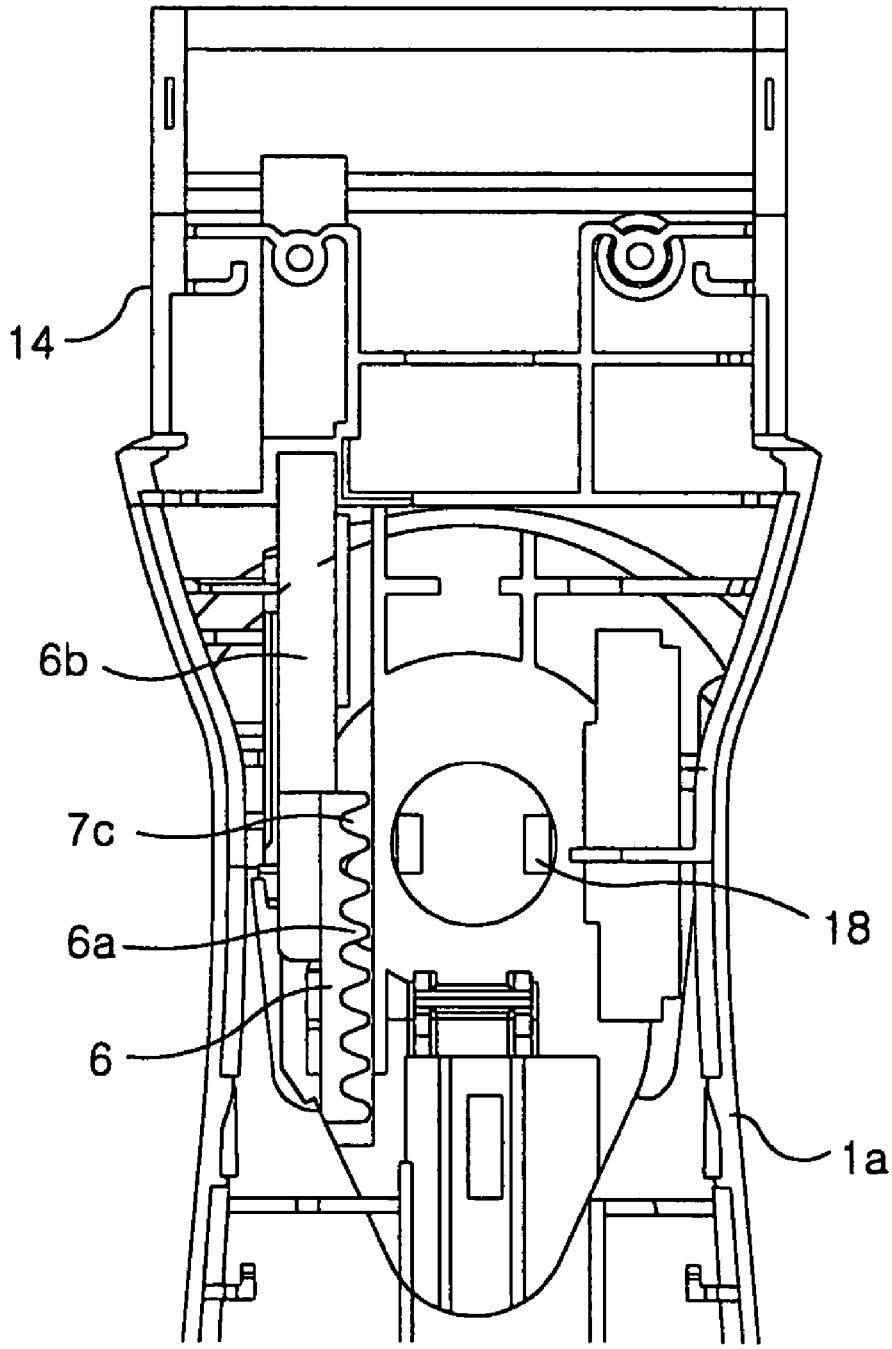

When the rotary dial 7 is rotatably mounted on the mortise 10, the rear protrusion portion 7*b* is inserted into the annular recess 11, and the click gear 7*d* becomes interlocked with the push protrusion portion 16*a* of the click spring 16. Further, the interlocking gear wheel 7*c* is meshed with the rack gear portion 6*a* of the connecting member 6, as illustrated in FIG. 4C.

By installing the dial retaining plate 17 when mounting the rotary dial 7 on the main body 1, it is possible to prevent the rotary dial 7 from separating from the main body 1. The engaging portion 17*a* is protrudingly formed at the outermost end of the dial retaining plate 17 toward the rear portion. Further, slide engaging tracks 17*b,* which are a pair of elongated holes, and an extension piece 17*d* having a display hole 17*c* is protrudingly provided on the outer circumference of the dial retaining plate 17.

Figure 4D:
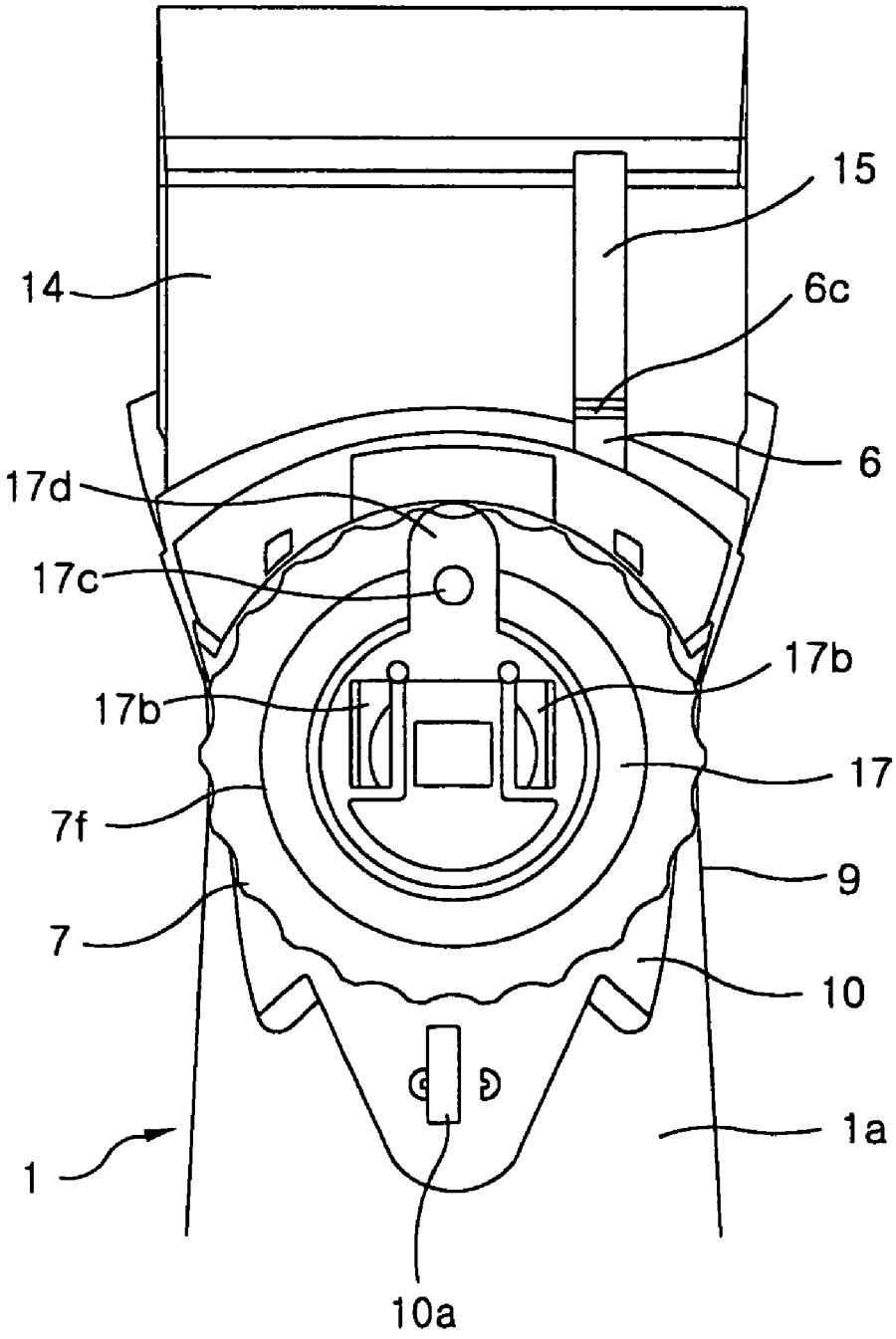

Further, as illustrated in FIG. 4D, by fitting the dial retaining plate 17 into the larger diameter section 7*f* of the dial unit 7*a* and engaging the engaging portion 17*a* with the engagement holes 18 provided at the main body 1, the dial retaining plate 17 allows the rotary dial 7 to freely rotate but prevents it from being separated from the main body 1. When the dial retaining plate 17 is keeping in place the rotary dial 7, the extension piece 17*d* covers the surface of the dial unit 7*a*.

As illustrated in FIG. 3, the operation switch 8, seen from the front, has a triangular shape, and a protrusion or recess for better finger grip is formed on its surface. A pair of engagement hooks 30 and a switching protrusion 31 are protrudingly installed on the rear portion of the operation switch. Further, an elongated hole-shaped window portion 32 is provided in the operation switch 8.

Figure 4E:
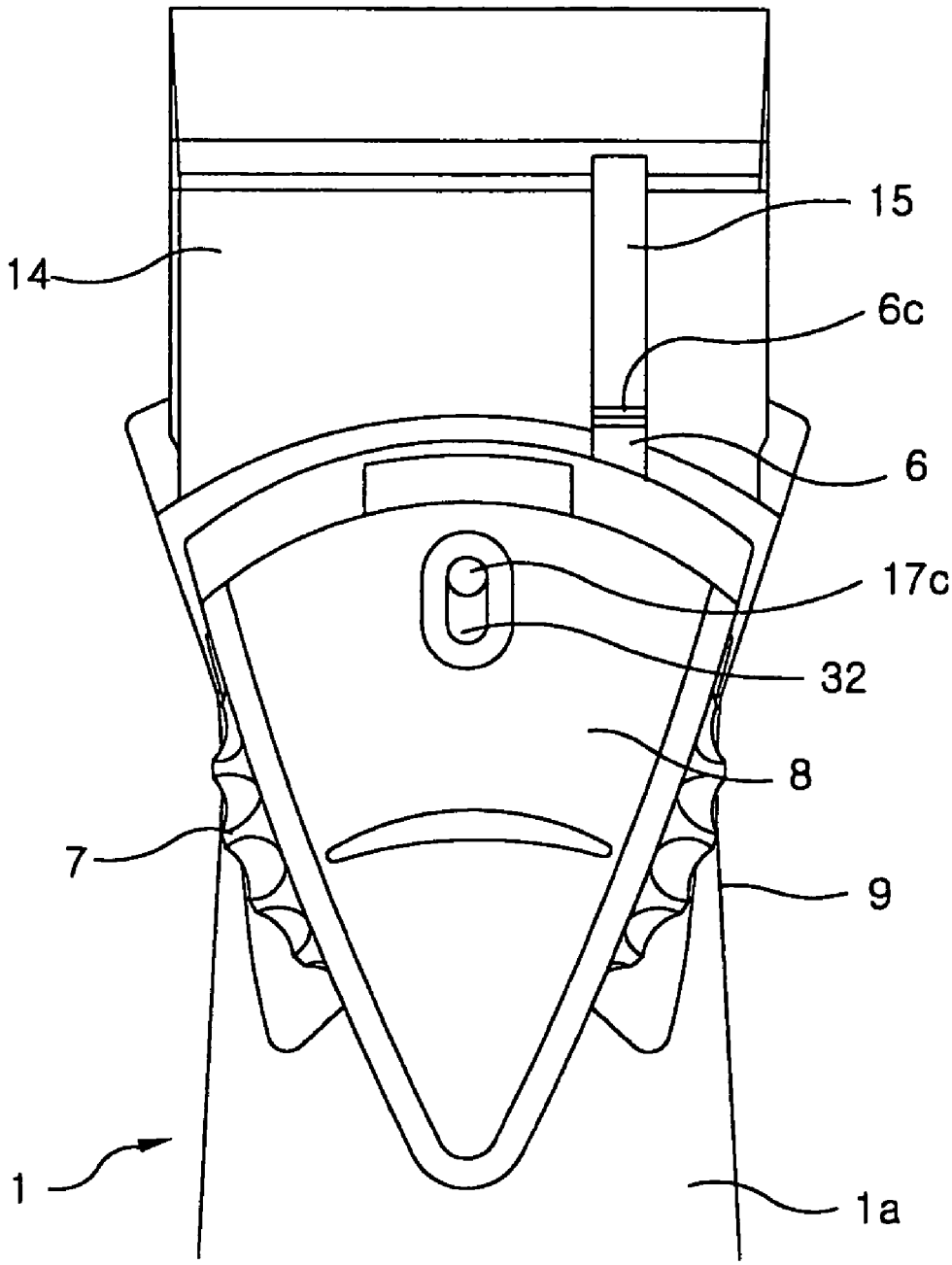
Figure 6:
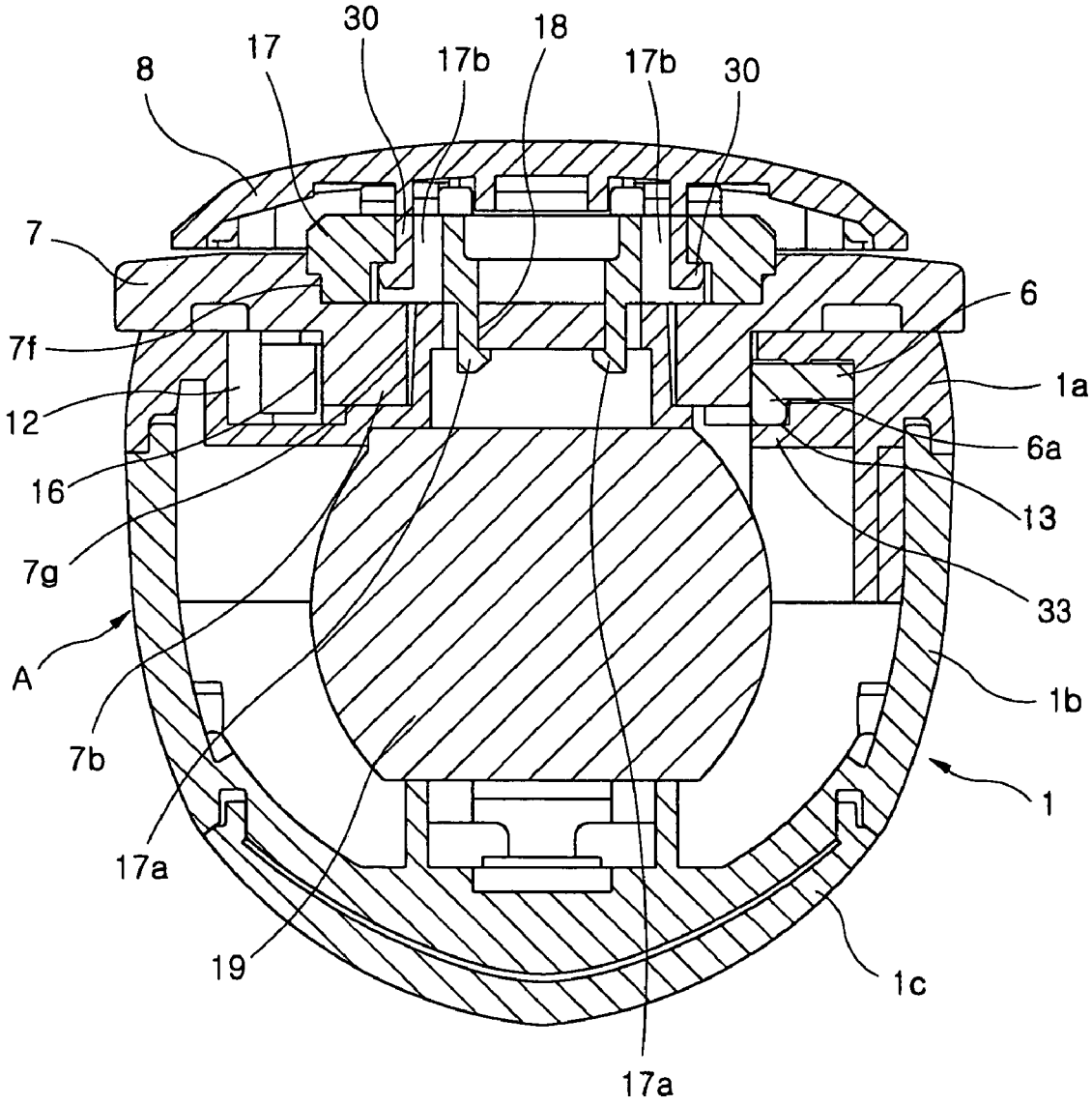
FIG. 6 shows a cross-sectional view of a portion accommodating therein the rotary dial, a dial retaining plate and an operation switch of the present invention.
Figure 12A:
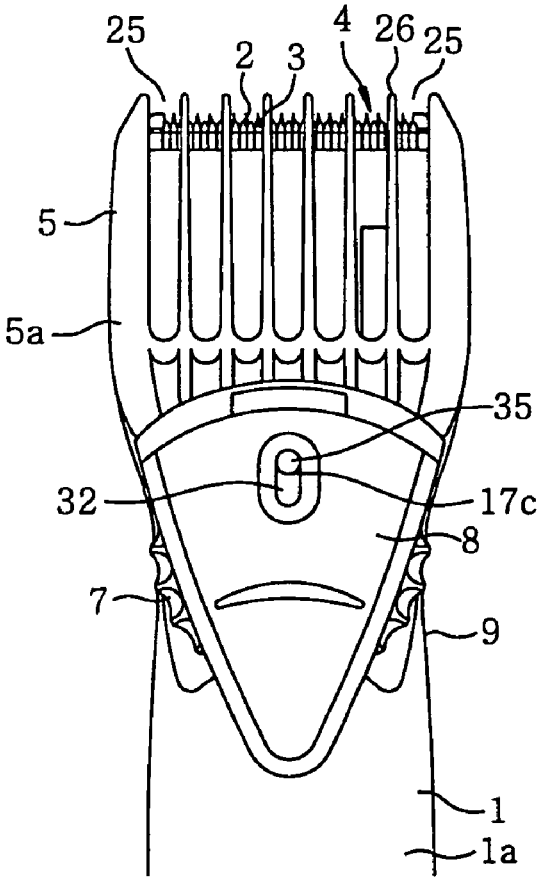
FIGS. 12A and 12B are front views obtained wherein the trim length position is changed by moving the comb attachment of the present invention.
Figure 12B:
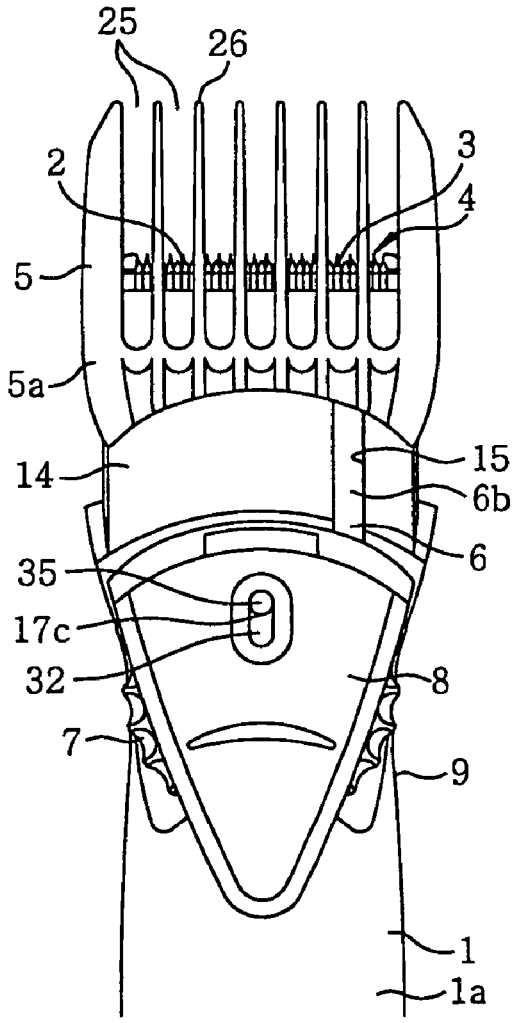

The operation switch 8 described above is disposed on the exterior of the rotary dial 7 in the mortise 10, as illustrated in FIG. 4E. As shown in FIG. 6, the pair of engagement hooks 30 are slidably engaged with the slide engaging tracks 17*b,* which are a pair of elongated holes. Further, the switching protrusion 31 is movably inserted into the switching hole 10*a* provided in the mortise 10 so that the switching protrusion is fitted with the engagee hole of the switch mechanism provided at the other side the switching hole 10*a*. As a result, the operation switch 8 is movably installed in the longitudinal direction of the main body 1, namely, closer or further from the cutter block 4. Further, regardless of the operation switch 8's position relative to the cutter block 4, the display hole 17*c* of the extension piece 17*d* is always exposed by the window portion 32. Therefore, as shown in FIGS. 12A and 12B, the control-step marks 35 such as scales, numbers or the like are displayed through the long hole-shaped window portion 32 via the display hole 17*c* regardless of the operation switch 8's position, wherein the control-step marks 35 are provided along the circumferential direction on the surface of the rotary dial 7.

In this manner, the rotary dial 7 which transmits its movement to the connecting member 6 is disposed at one side surface of the main body 1 approximately in parallel with the corresponding one side surface, and the operation switch 8 is disposed at the exterior of the same side surface of the main body 1 over the rotary dial 7. Disposing the operation switch 8 over the rotary dial 7, thereby overlapping them in the same place of the main body 1, the length of the main body 1 becomes shorter in comparison with a design having the operation switch 8 and the rotary dial 7 disposed at different places of the main body 1 along the lengthwise direction. Further, the overall size of the main body can be made smaller as a result.

In this case, some part of the outer circumferential portion of the rotary dial 7 is exposed from the operation switch 8. In the preferred embodiment illustrated in the accompanying drawings, some part of the rotary dial 7 is projected from the sides of the operation switch 8. Further, the operation switch 8, seen from the front, is formed in a V shape in which the width becomes narrower from one side to the other, wherein the portion where the width is the narrowest is placed furthest from the cutter block 4 on the main body 1. Some Part of the rotary dial 7 is projected and exposed from both sides of the operation switch 8 at a section where the width of the V-shaped operation switch 8 turns narrower.

If the operation switch 8 is moved in the lengthwise direction of the main body 1, the switch mechanism then turns on/off a driving mechanism 19 such as a motor or a linear actuator accommodated in the main body 1, thereby driving the movable blade 3 of the cutter block 4 to reciprocate or otherwise, stopping the operation thereof (the driving mechanism 19 is turned on when the operation switch 8 is moved closer to the cutter block 4 whereas it is turned off if moved further from the cutter block 4).

Figure 9A:
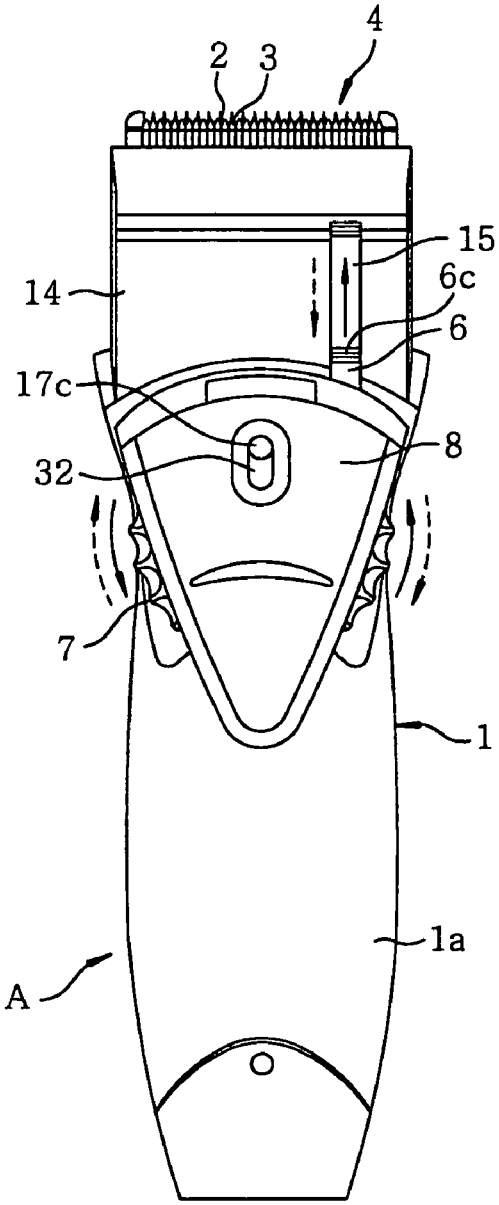
FIGS. 9A and 9B respectively are a front view and a right side view illustrating an operation of the rotary dial and resulting movement of a connecting member in the hair trimmer wherein the comb attachment of the present invention is detached from the main body.
Figure 9B:
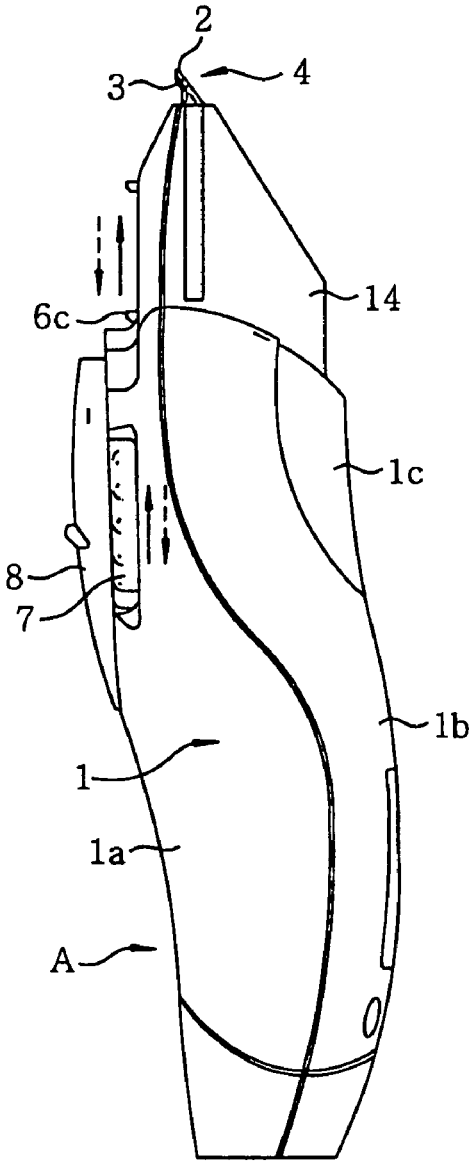
Figure 10A:
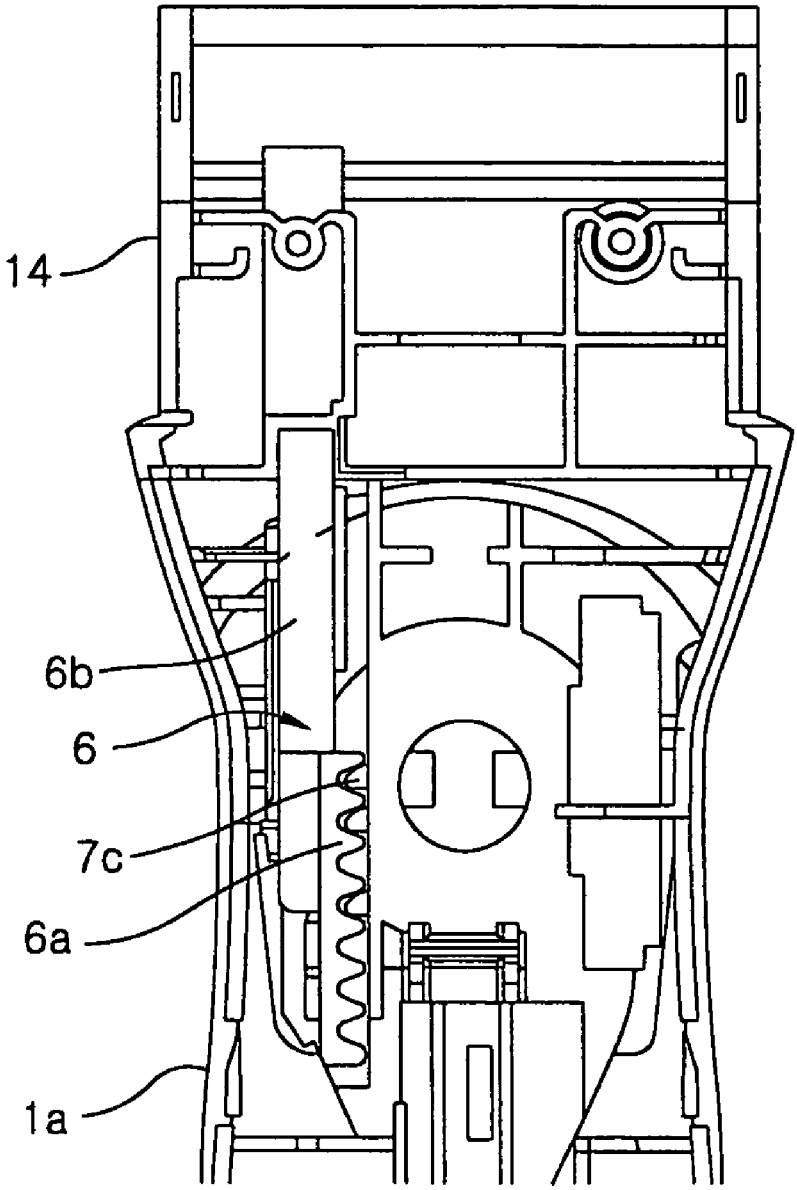
FIGS. 10A and 10B are detailed drawings to illustrate changes in the meshed position between an interlocking gear wheel and a rack gear portion when the rotary dial is turned.
Figure 10B:
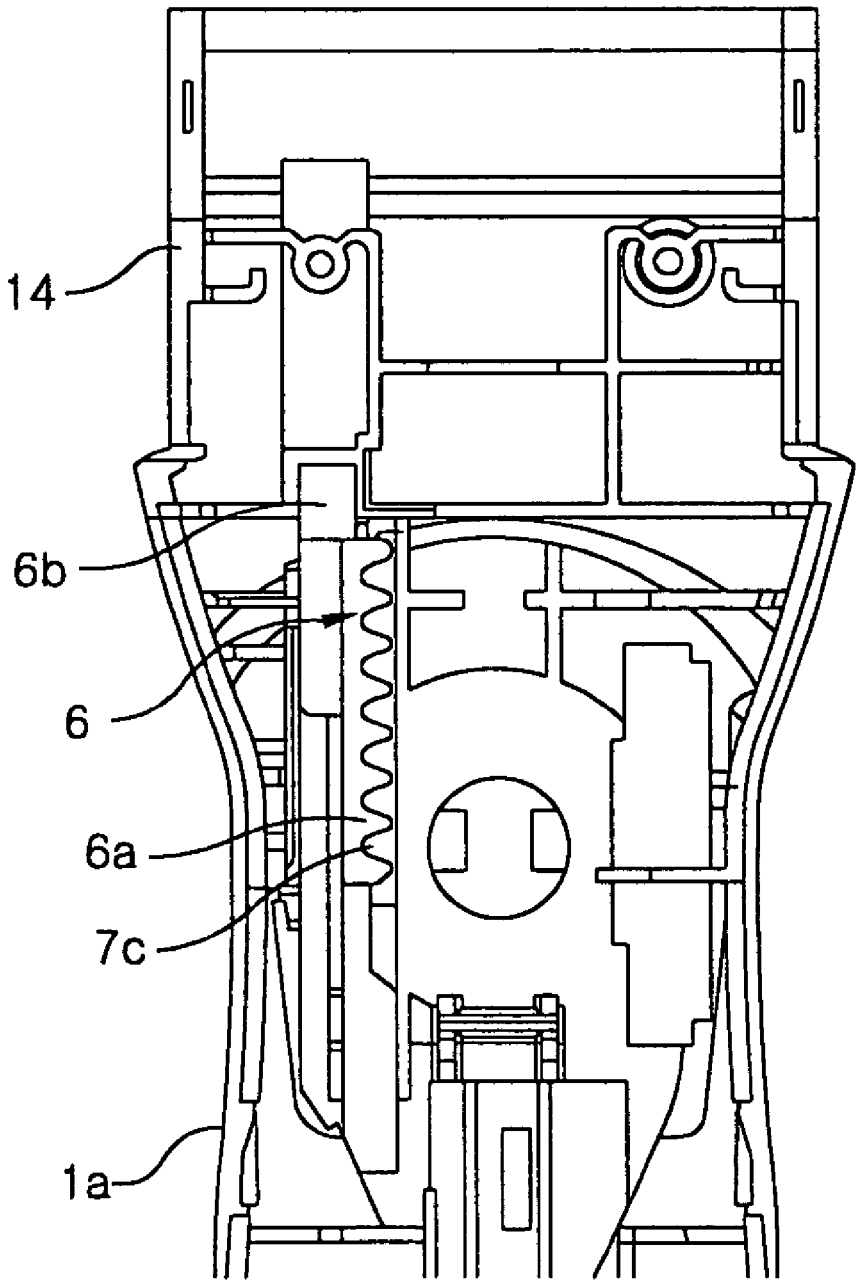

Further, since the interlocking gear wheel 7*c* is engaged with the rack gear portion 6*a* of the connecting member 6 as illustrated in FIGS. 10A and 10B, if the rotary dial 7 is turned as shown by the arrows in FIGS. 9A and 9B, the connecting member 6 moves in the lengthwise direction of the main body 1. Further, since the linking arm 6*b* of the connecting member 6 slides in the elongated groove 15, the engaging hook 6*c* at the end of the linking arm 6*b* slides along the elongated groove 15.

Figure 7:
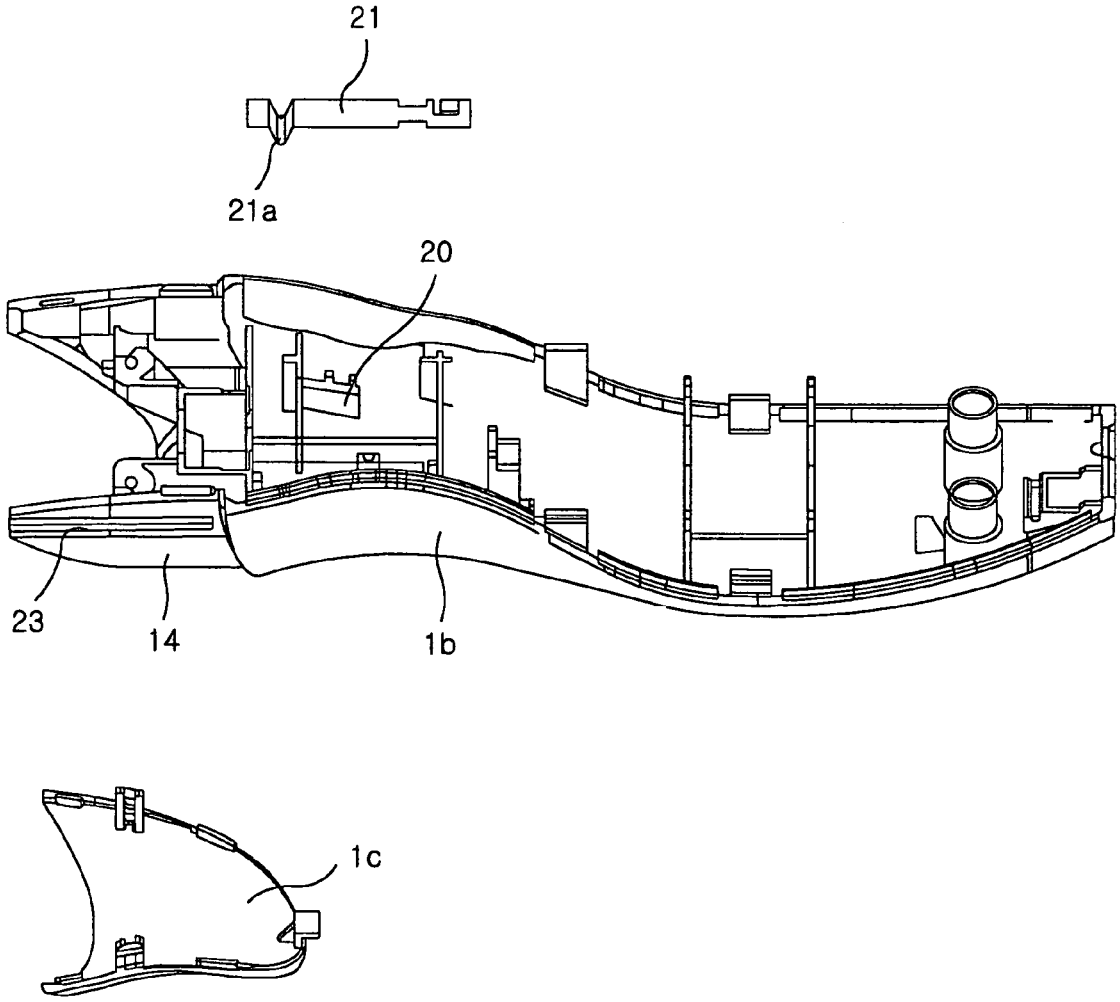
FIG. 7 is an exploded perspective view which shows accommodating an elastic member in the main body of the hair trimmer of the present invention.
Figure 8A:
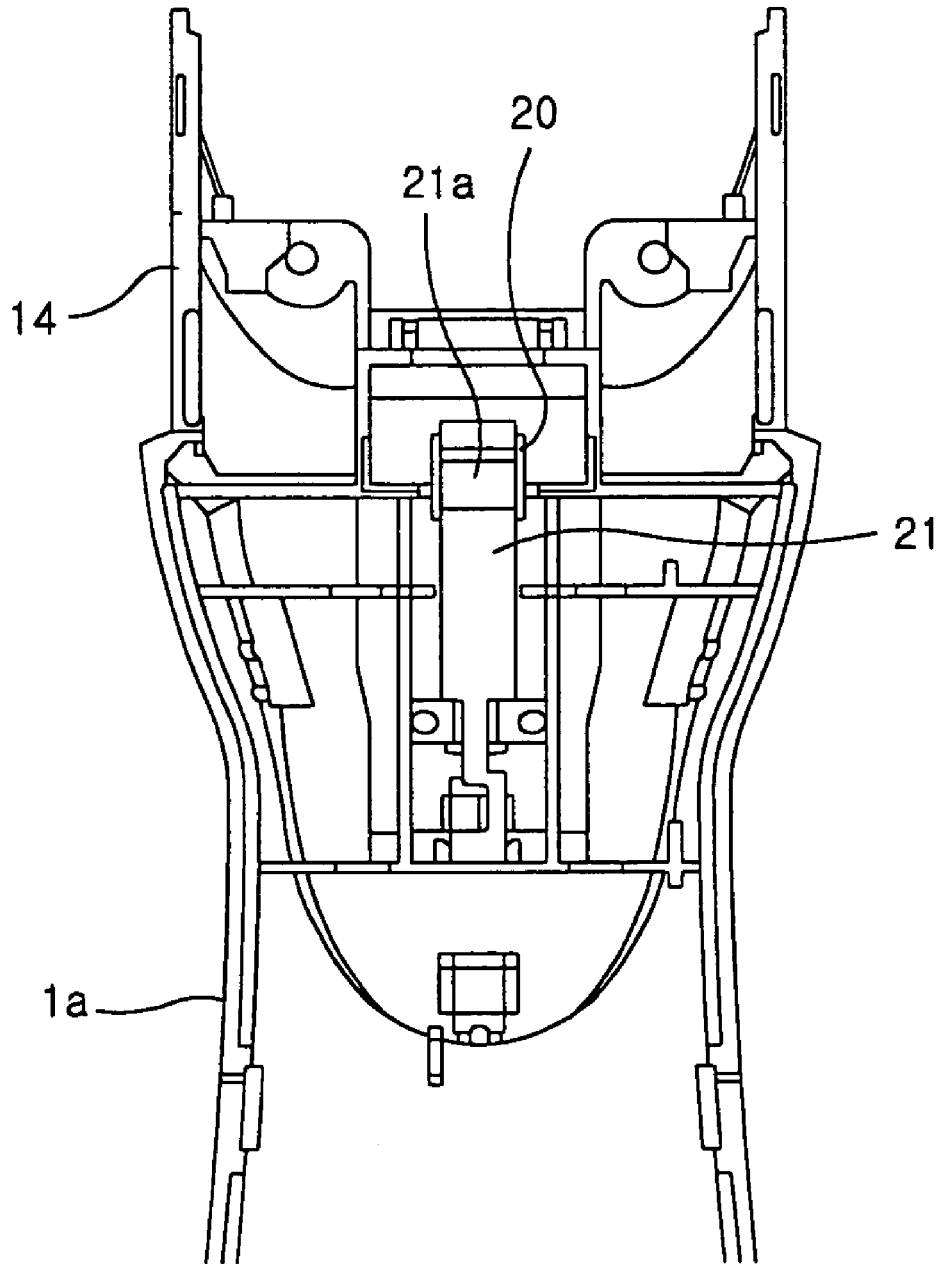
FIGS. 8A and 8B are a front view and a cross-sectional view showing the elastic member accommodated in the main body of the present invention, respectively.
Figure 8B:
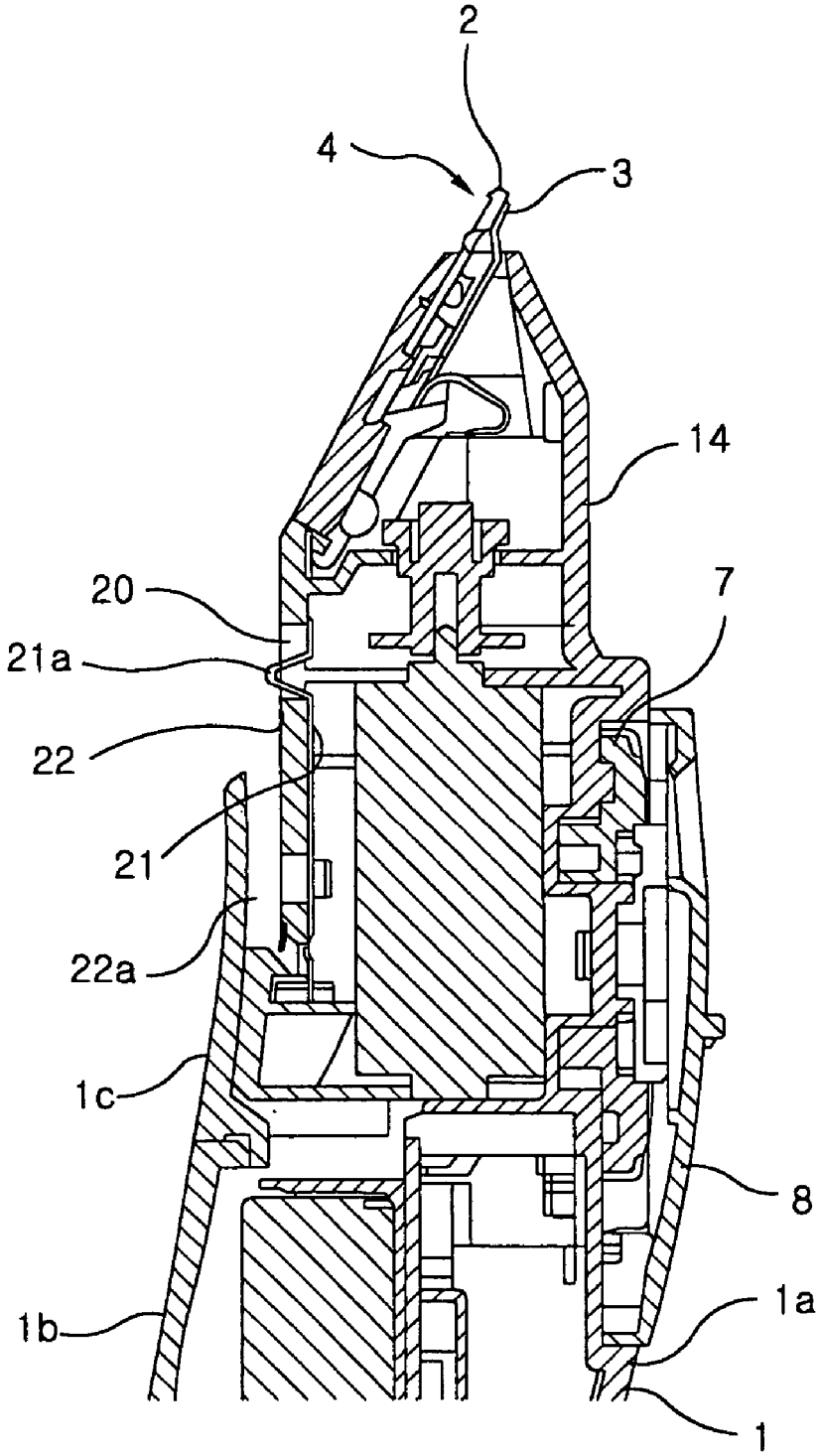

As shown in FIG. 2C, the guide groove 22 is provided at the comb attachment placement head 14 of the housing 1*b*, which is the rear portion of the main body 1. At the bottom portion of the guide groove 22, a window portion 20, which runs through externally and internally is provided. Installed in the housing 1*b* is the elastic member 21 made of an elastic material as shown in FIGS. 7, 8A and 8B. An elastic pressing protrusion 21*a* of the corresponding elastic member 21 is projected out through the window portion 20.

The housing 1*c* is installed on housing 1*b* such that it covers a part of the housing 1*b* and a part of the guide groove 22 of the housing 1*b* (a portion away from the cutter block 4). The receiving groove portion 22*a* is provided with a part of the guide groove 22 and the housing 1*c*.

Further, guiding rail portions 23 are provided on both left/right sides of the comb attachment placement head 14 of the main body 1 along the lengthwise direction of the main body 1.

The cylindrical comb attachment 5 has one open end portion and slidably covers the comb attachment placement head 14 of the main body 1 having the cutter block 4 at one end portion thereof.

As described above, while the comb attachment placement head 14 of the main body 1 is covered by the cylindrical comb attachment 5 with one open end portion for trim length attachment, among the sides of the cylindrical comb attachment 5, if the side where the operation switch is disposed is defined as the front side portion 5*a*, the side portion facing the front side portion 5*a* becomes a rear side portion 5*b*. Further, the side portions connecting both edge portions of the front side portion 5*a* and the rear side portion 5*b* become left/right side portions 5*c*, and the side portion facing the opening becomes an end surface portion 5*d*. Further, multiple rows of slits 25 are formed from the front side portion 5*a* to the rear side portion 5*b* via the end surface portion 5*d* to thereby form a comb-shaped section 26.

Figure 11A:
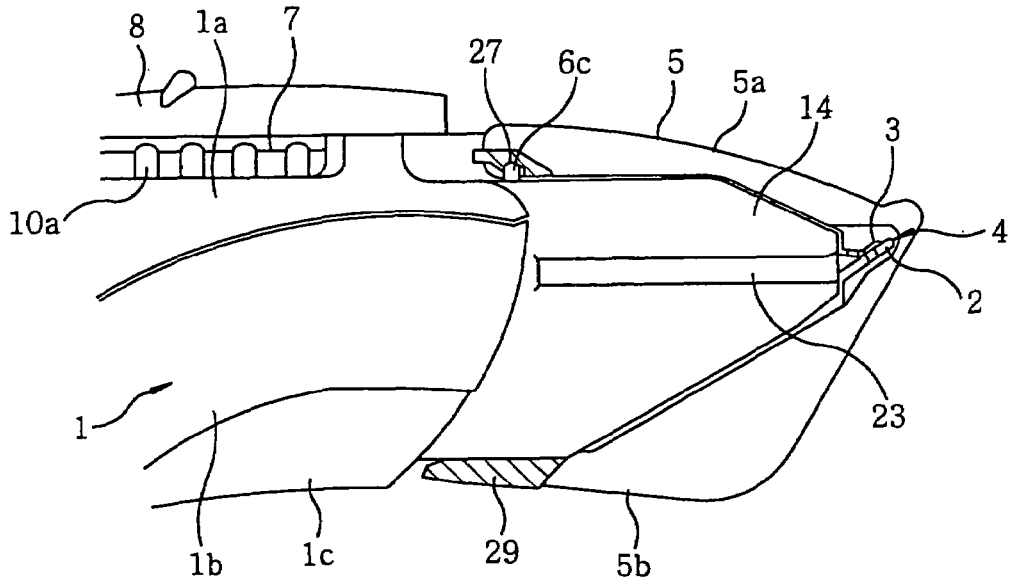
FIGS. 11A and 11B are cross-sectional views of the engaged section between an engager portion formed on the comb attachment and an engagee portion of the connecting member, wherein the trim length position is changed by moving the comb attachment of the present invention.
Figure 11B:
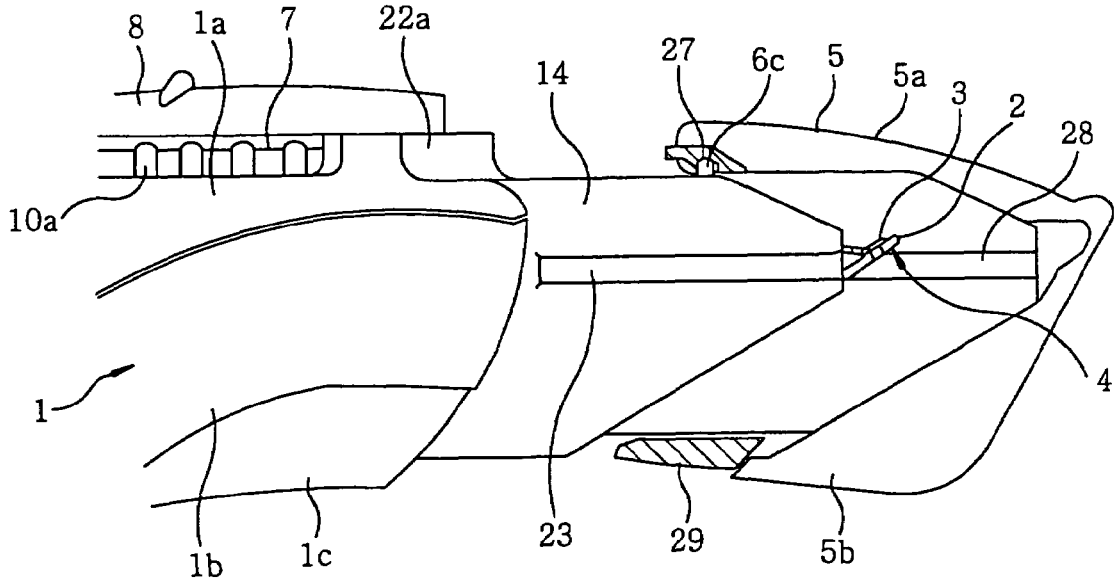

An engager portion 27 is disposed on the inner surface of the front side portion 5*a* of the cylindrical comb attachment 5. As illustrated in FIGS. 11A and 11B, the engager portion 27 is engaged with the engaging hook 6*c* of the connecting member 6 while the cylindrical comb attachment 5 is covering the comb attachment placement head 14 of the main body 1. Further, guided rail portions 28 are disposed on inner surfaces of the left/right side portions 5*c* and slidably inserted into the guiding rail portions 23 provided on the comb attachment placement head 14 while the cylindrical comb attachment 5 is covering the comb attachment placement head 14 of the main body 1.

Figure 13A:
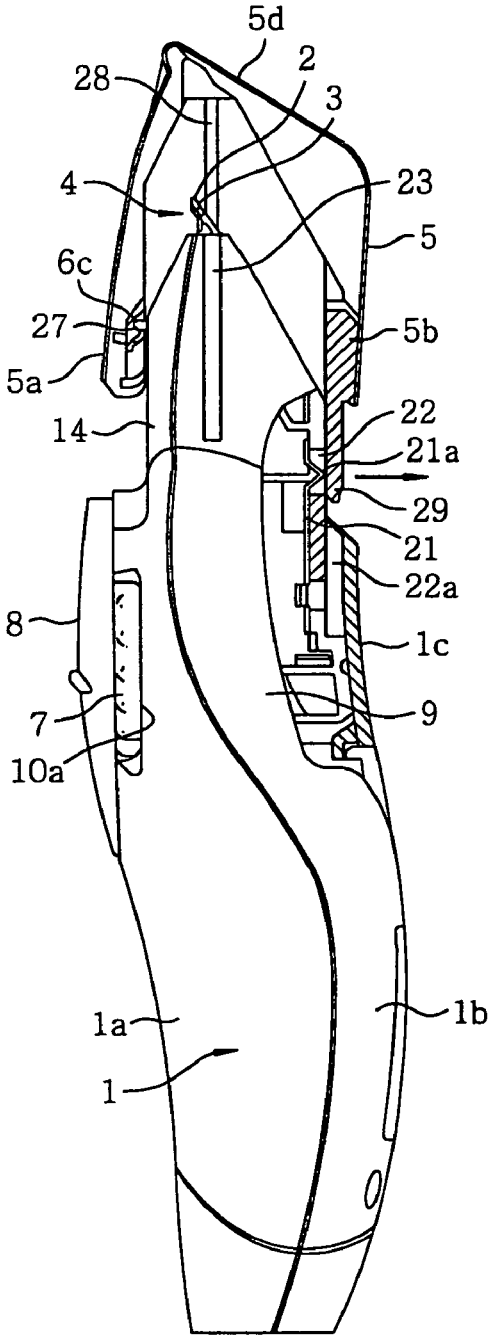
FIGS. 13A and 13B are partial cross-sectional side views of an elastically contacting section between a receiving element and an elastic element, wherein the trim length position is changed by moving the comb attachment of the present invention.
Figure 13B:
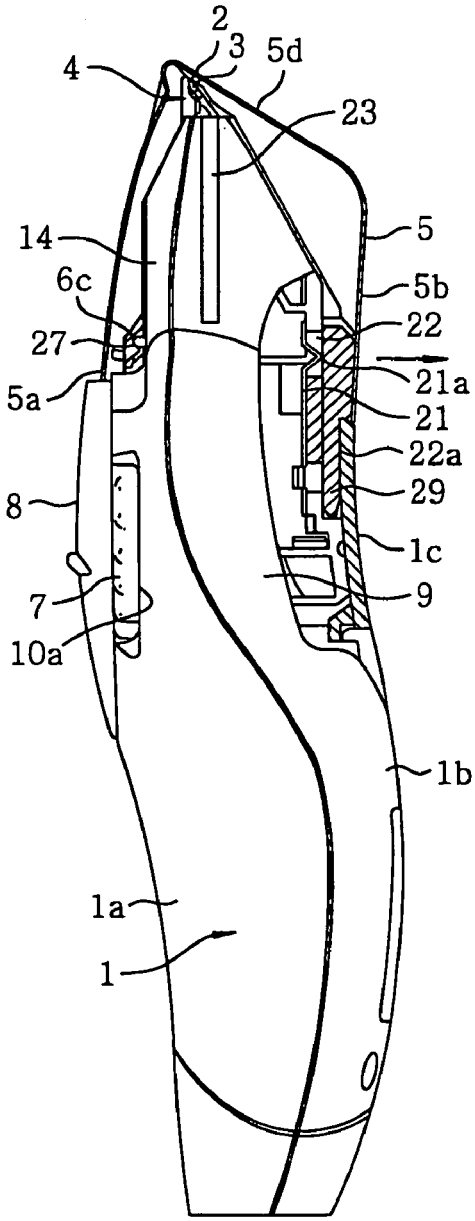
Figure 14A:
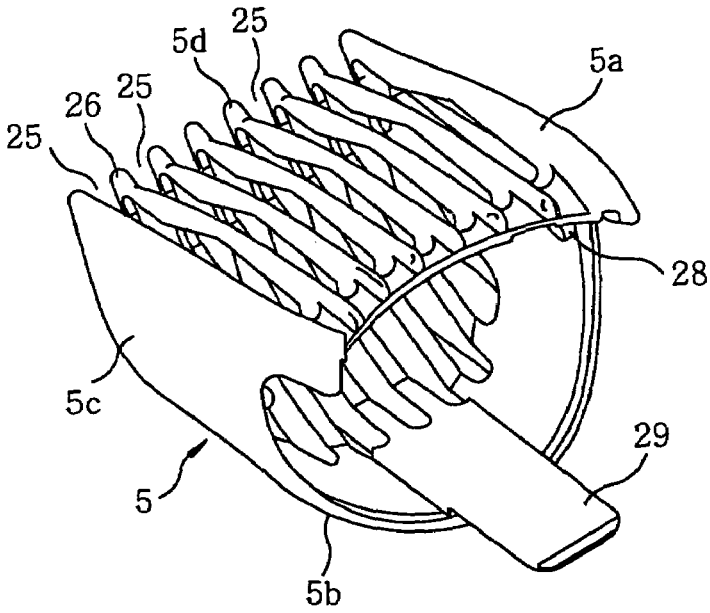
FIGS. 14A and 14B show perspective views of a front portion and a rear portion of the comb attachment for the trim length adjustment respectively used in the present invention.
Figure 14B:
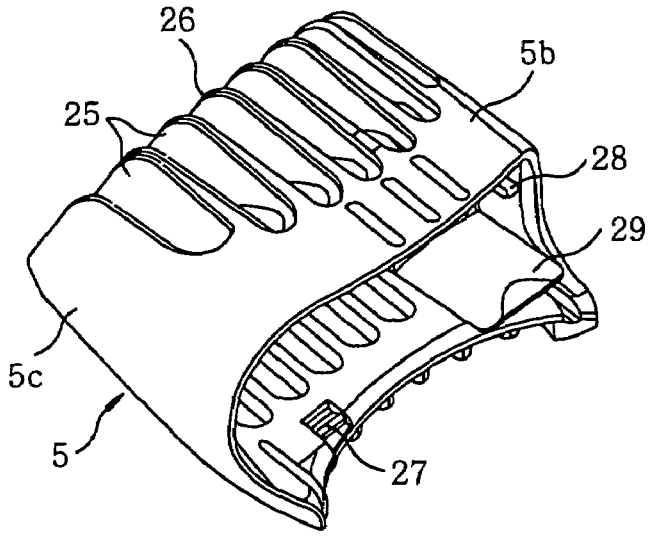
Figure 15A:
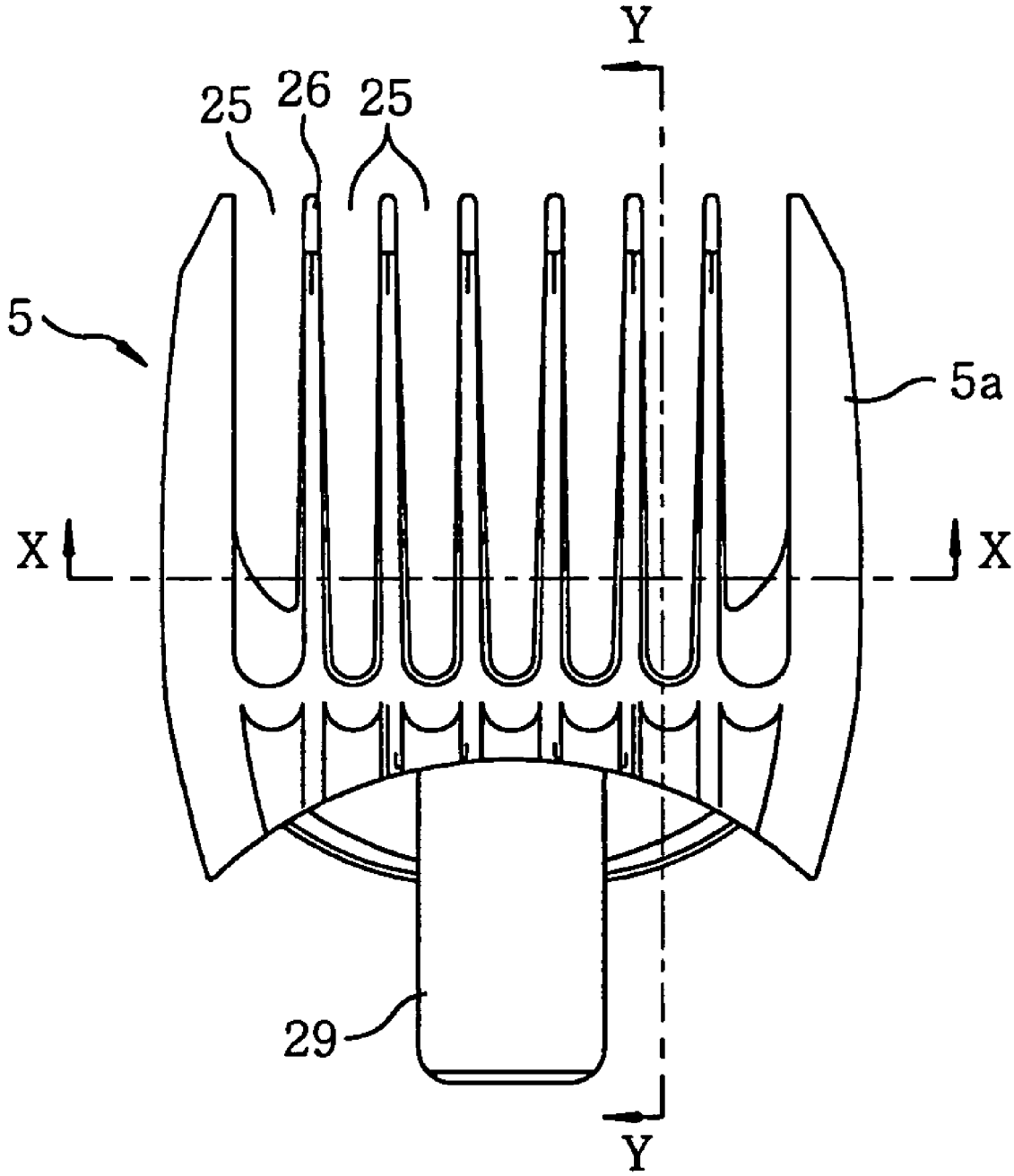
FIGS. 15A to 15C show a front view and cross-sectional views taken along line Y-Y and line X-X of the comb attachment used in the present invention, respectively.
Figure 15B:
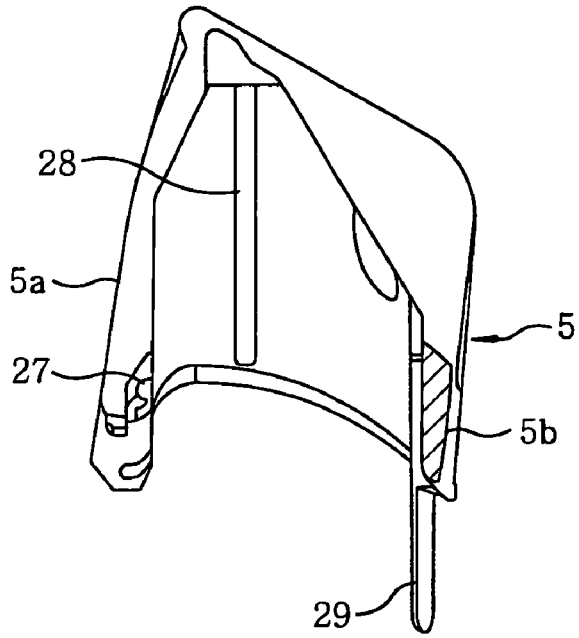
Figure 15C:
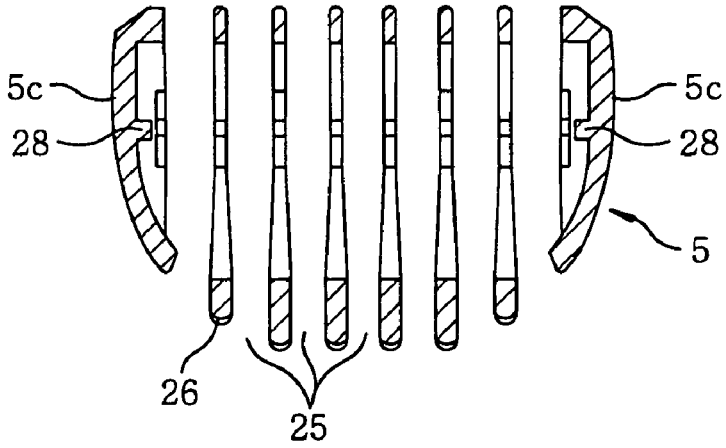

Further, a flat plate-shaped pressure receiving element 29 is provided at the rear side portion 5*b* of the cylindrical comb attachment 5 and projected from the inner surface of the rear side portion 5*b* toward the opposite direction of the end surface portion 5*d* via the open end. Further, a elastic pressing protrusion 21*a* of the elastic member 21 projecting through the window portion 20 of the main body 1 is elastically in contact with the pressure receiving element 29 while covering the comb attachment placement head 14 of the main body 1 with the cylindrical comb attachment 5. The pressing direction on the pressure receiving element 29 by the elastic pressing protrusion 21*a* of the elastic member 21 is perpendicular to the moving direction of the comb attachment 5 (in this case, the perpendicular direction in the present invention includes an approximately perpendicular direction). Further, as illustrated by arrows of FIGS. 13A and 13B, the comb attachment 5 is elastically in contact with the comb attachment placement head 14 regardless of the comb attachment 5's location relative to the comb attachment placement head 14. Accordingly, even if the comb attachment 5 is sized slightly loosely relative to the main body 1 so that it moves easily on the main body 1, the comb attachment 5 is always elastically pressed by the elastic member 21 approximately perpendicular to the sliding direction of the comb attachment 5 so that the cylindrical comb attachment 5 does not rattle on the comb attachment placement head 14, thereby eliminating a rattling noise.

Especially, since the portion where an elastic force of the elastic member 21 is applied to the comb attachment 5 approximately perpendicular to the moving direction of the comb attachment 5 is located on the opposite side with respect to the connecting portion where the cylindrical comb attachment 5 and the main body 1 are engaged (i.e., the connecting portion where the engager portion 27 of the comb attachment 5 is engaged with the engaging hook 6*c* of the connecting member 6 disposed in the main body 1), the elastic pressing on the comb attachment also serves to eliminate the rattling in the connecting portion between the cylindrical comb attachment 5 and the main body 1. Further, even if the corresponding connecting portion is loosely sized, it is possible to prevent its rattling as well, therefore its rattling noise.

Further, in the embodiment described above, with respect to the elastic member 21 for elastically pressing the comb attachment 5 in an approximately perpendicular direction to its moving direction is disposed in the main body 1. However, it is possible to install the elastic member 21 in one of the four sides of the cylindrical comb attachment 5 so that the elastic member 21 elastically presses corresponding one side of the main body 1. As a result, the same effect can be achieved by elastically pressing the guided rail portions 28 or the side portion opposite to where the elastic member 21 of the cylindrical comb attachment 5 in an approximately perpendicular direction to the moving direction of the comb attachment 5.

A step-by-step use of the hair trimmer A having the aforementioned comb attachment 5 movably disposed will be described in detail hereinafter.

Namely, while holding the main body 1 with one hand, the trim length is adjusted by turning the rotary dial 7 so that the comb attachment 5 would move in the projected direction of the cutter block 4. By turning on the operation switch, the movable blade 3 would start to reciprocate, and hair or bear brought in through the slits between the comb-shaped section 26 of the comb attachment 5 is cut by the stationary blade 2 and the movable blade 3 at desired trim length. In this case, as discussed above regarding the present invention, since the operation switch 8 is disposed over the rotary dial 7 at the same place on the main body 1, when cutting hair or beard while grabbing the main body 1 with the hand, the operation switch 8 and the rotary dial 7 can be controlled with the same hand holding the trimmer's main body without switching hands. Therefore, the manipulability of the hair trimmer is enhanced.

In this case, as in the embodiment illustrated in the accompanying drawings, along the lengthwise direction of the main body 1, a neck portion 9 having a narrow width between both sides is formed, and the rotary dial 7 and the operation switch 8 are disposed on a side perpendicular to both sides of the corresponding neck portion. Therefore, when the main body 1 which is to be hand held is grabbed by the hand, the main body 1 would be grabbed in a manner such that the thumb and the index finger would be placed on the neck portion 9, and the rotary dial 7 and the operation switch 8 can be reached by the tip of the thumb while holding the main body 1. Accordingly, a user can easily operate the rotary dial 7 and the operation switch 8 without switching hands.

In order to operate the operation switch 8 while holding the main body 1 with one hand, the hair trimmer can be turned on and off only by sliding the thumb in the lengthwise direction of the main body 1 without switching hands while pressing on the surface of the operation switch 8. Further, in order to operate the rotary dial 7 while holding the main body 1 with one hand, by turning the exposed part of the rotary dial 7 from the operation switch 8, a desired trim length adjustment can be obtained simply by shifting the rotary dial 7 with the thumb without switching hands, thereby moving the comb attachment 5.

Since a part of the rotary dial 7 is exposed from the side of the operation switch 8 as shown in the embodiment in the accompanying drawings, when the exposed part of the rotary dial 7 projecting from the side of the operation switch 8, is changed with the fingers, the rotary dial 7 is easily turned without disturbing the operation switch 8 thereby further enhancing the manipulability of the hair trimmer. In this case, as shown in FIG. 9A, the operation switch 8 has a V-shape in which the width becomes narrower from one side to its opposite side while the apex portion having the narrowest width is oriented away from the cutter block 4, so that the rotary dial 7 is exposed from the operation switch 8 at the portion where the width gets narrower. Therefore, when the rotary dial 7 is turned while the main body 1 is held the hand, a user can easily shift the rotary dial 7 without disturbing the operation switch 8.

However, when a user turns the rotary dial 7, it causes a change in the relatively meshed section between the interlocking gear wheel 7*c* and the rack gear portion 6*a* of the connecting member 6, thereby moving the connecting member 6 and shifting the comb attachment 5 in stages. In this case, when the comb attachment 5 is moved in stages, since the click gear 7*d* and the push protrusion portion 16*a* of the click spring 16 stay interlocked at different shifting stages, each shifting position can be maintained. Further, when shifting the trim length by turning the rotary dial 7 to adjust the position of the comb attachment 5, a user would notice a clicking sensation accompanied by a clicking sound, thereby the trim length can be adjusted with confidence. Further, as shown in FIGS. 12A and 12B, the control-step marks 35 such as scales or numbers to indicate different trim length levels corresponding to various cutting lengths is displayed thorough the window portion 32, so that the trim length levels can be checked by looking at the displayed mark.

With the present invention, as for movably disposing the cylindrical comb attachment along the reciprocating direction of the cutter block of the main body, even if the comb attachment is slightly loosely sized relative to the main body without requiring its precise dimensions, the rattling of the comb attachment perpendicular to its trim length adjustment direction can be prevented, thereby eliminating a rattling noise. Further, since the comb attachment can be smoothly adjusted on the main body, the manipulability of the hair trimmer is enhanced. Further, as noted above, since the comb attachment does not need to be sized precisely, it becomes easier to streamline the product quality maintenance by taking advantage of such an unsophisticated structure, ultimately making mass production easier.

While the invention has been shown and described with respect to the preferred embodiments, it will be understood by those skilled in the art that various changes and modifications may be made without departing from the spirit and scope of the invention as defined in the following claims.

The invention claimed is:

1. A hair trimmer with a rattle dampening structure, comprising:

an elongated main body;

a cutter block having a stationary blade and a movable blade, both of which are comb-shaped and are slidably in contact with each other, the cutter block being protrudingly installed at one end of the main body;

a comb-shaped cylindrical comb attachment covering the cutter block such that it is movable in a projected direction of the cutter block for trim length adjustment;

an elastic member for elastically pressing the comb attachment in a direction approximately perpendicular to a moving direction of the comb attachment; and a connecting member provided on the main body, which is moved by a control mechanism;

wherein the connecting member is engaged with the comb attachment at one sidewall of the comb attachment to thereby slidably move the comb attachment; and wherein the elastic member is installed at the main body and presses a side of the comb attachment opposing said one sidewall and the comb attachment slides on the elastic member when the comb attachment moves along the moving direction of the comb attachment;

wherein the comb attachment includes a tongue portion protruded along the moving direction thereof, and the elastic member presses the tongue portion substantially perpendicular to a moving direction of the movable blade.

2. The hair trimmer of claim 1, further comprising:

guided rail portions provided on the comb attachment in parallel with the moving direction of the comb attachment; and guiding rail portions provided on the main body, wherein the guided rail portions are slidably inserted in the guiding rail portions.

3. The hair trimmer of claim 1, further comprising:

a pressure receiving element provided on the comb attachment so that it is in contact with the elastic member; and a receiving groove portion provided in the main body, wherein a part of the pressure receiving element is movably inserted in the receiving groove portion.

4. A hair trimmer with a rattling dampening structure, comprising:

an elongated main body;

a cutter block, having a stationary blade and a movable blade, projected from the main body;

a comb-shaped comb attachment covering the cutter block such that it is movable in a projected direction of the cutter block for trim length adjustment;

a control mechanism provided on the main body;

a connecting member provided on the main body, which is slidably moved by the control mechanism; and an elastic member provided on the main body for elastically pressing the comb attachment;

wherein the connecting member is engaged with the comb attachment such that the comb attachment is slidably moved on the elastic member along a moving direction of the connecting member, and wherein the control mechanism and the connecting member are disposed at one side of the main body and the elastic member is disposed on another side of the main body opposite to said one side;

wherein the comb attachment includes a tongue portion protruded along the moving direction thereof, and the elastic member presses the tongue portion substantially perpendicular to a moving direction of the movable blade.

5. The hair trimmer of claim 4, wherein the elastic member is disengaged from the control mechanism such that the elastic member is not movable with the connecting member by the control mechanism.

6. A hair trimmer with a rattling dampening structure, comprising:

an elongated main body;

a cutter block, having a stationary blade and a movable blade, projected from the main body;

a comb-shaped comb attachment covering the cutter block such that it is movable in a projection direction of the cutter block for trim length adjustment;

a control mechanism provided on the main body;

a connecting member provided on the main body, which is moved by the control mechanism; and an elastic member provided on the main body for elastically pressing the comb attachment;

wherein the connecting member is engaged with comb attachment such that the comb attachment is movable along a moving direction of the connecting member, and the elastic member is disengaged from the control mechanism such that the elastic member is not movable with the connecting member by the control mechanism.

7. The hair trimmer of claim 6, wherein the comb attachment includes a tongue portion protruded along the moving direction thereof, and the elastic member presses the tongue portion substantially perpendicular to a moving direction of the movable blade.

* * * * *